US010854044B2

(12) United States Patent
Shapiro et al.

(10) Patent No.: US 10,854,044 B2
(45) Date of Patent: Dec. 1, 2020

(54) CONTROLLING AN ELECTRONIC GAMING MACHINE TO PROVIDE A BONUS FEATURE OPPORTUNITY

(71) Applicant: Aristocrat Technologies Australia Pty Limited, North Ryde (AU)

(72) Inventors: Lane Alan Shapiro, Las Vegas, NV (US); Erick T. Ching, Cedar Park, TX (US); Chad La Guardia, Austin, TX (US); Hanna Lee Sanborn, Pflugerville, TX (US); Arlen Avakian, Plano, TX (US); Brittany Nyberg Nelson, Liberty Hill, TX (US)

(73) Assignee: Aristocrat Technologies Australia Pty Limited, North Ryde (AU)

( * ) Notice: Subject to any disclaimer, the term of this patent is extended or adjusted under 35 U.S.C. 154(b) by 5 days.

(21) Appl. No.: 16/290,836

(22) Filed: Mar. 1, 2019

(65) Prior Publication Data

US 2020/0279456 A1 Sep. 3, 2020

(51) Int. Cl.
*G07F 17/32* (2006.01)

(52) U.S. Cl.
CPC ..... *G07F 17/3267* (2013.01); *G07F 17/3213* (2013.01); *G07F 17/3244* (2013.01)

(58) Field of Classification Search
CPC ..... G07F 17/32
See application file for complete search history.

(56) References Cited

U.S. PATENT DOCUMENTS

| | | | | |
|---|---|---|---|---|
| D259,499 | S | 6/1981 | Dunham | |
| 5,342,518 | A | 8/1994 | Posner | |
| 5,767,854 | A | 6/1998 | Anwar | |
| 6,620,045 | B2 * | 9/2003 | Berman | G07F 17/3244 463/20 |
| D492,692 | S | 7/2004 | Fallon | |
| D499,786 | S | 12/2004 | Dropo | |
| D605,725 | S | 12/2009 | Chang | |
| 7,780,520 | B2 | 8/2010 | Baerlocher | |

(Continued)

OTHER PUBLICATIONS

"Cashman Casino," Sep. 2018 screenshot from YouTube video. Publication date Apr. 4, 2017, 1 page.

(Continued)

*Primary Examiner* — Reginald A Renwick
(74) *Attorney, Agent, or Firm* — Weaver Austin Villeneuve & Sampson LLP

(57) ABSTRACT

An electronic gaming machine (EGM) may present first visual effects on a display system, including game play items, corresponding to one or more instances of a base game and determining instances of game play items that correspond to feature credits towards an automatic award of a feature comprising one or more bonus games. The EGM may present second visual effects corresponding to an accumulation of feature credits towards the automatic award of the feature, receive an indication of a player's initiation of an attempt to trigger an award of the feature, at a time during which less than a number of feature credits necessary for an automatic award of the feature has been accumulated, determine whether an award of the feature will be triggered and control the display system to present third visual effects corresponding to whether an award of the feature has been triggered.

20 Claims, 10 Drawing Sheets

(56) References Cited

U.S. PATENT DOCUMENTS

| | | | | |
|---|---|---|---|---|
| 8,142,272 | B2 * | 3/2012 | Walker | G07F 17/32 463/16 |
| 8,439,733 | B2 | 5/2013 | Kay | |
| 8,585,494 | B2 | 11/2013 | Parrinello | |
| D695,778 | S | 12/2013 | Edwards | |
| D706,808 | S | 6/2014 | Edwards | |
| D710,372 | S | 8/2014 | Dellinger | |
| D741,897 | S | 10/2015 | Wilkinson | |
| D753,158 | S | 4/2016 | Mezzanotte | |
| D759,065 | S | 6/2016 | Mezzanotte | |
| D763,904 | S | 8/2016 | Knapp | |
| D771,670 | S | 11/2016 | Chan | |
| D772,894 | S | 11/2016 | Zhao | |
| D780,201 | S | 2/2017 | Zielinski | |
| D783,655 | S | 4/2017 | Hu | |
| D788,167 | S | 5/2017 | Fox Uribe | |
| D801,990 | S | 11/2017 | Reissner | |
| D823,336 | S | 7/2018 | Tinney | |
| D834,604 | S | 11/2018 | Feldman | |
| D836,653 | S | 12/2018 | Zhou | |
| D842,316 | S | 3/2019 | Toth | |
| D847,833 | S | 5/2019 | Toth | |
| D849,771 | S | 5/2019 | Foley | |
| D852,830 | S | 7/2019 | Penacho | |
| D854,554 | S | 7/2019 | Toth | |
| D861,703 | S | 10/2019 | Suslik | |
| D861,710 | S | 10/2019 | Frackelton | |
| D867,391 | S | 11/2019 | Yoshioka | |
| D868,825 | S | 12/2019 | Paulik | |
| D870,126 | S | 12/2019 | Crispino | |
| D876,450 | S | 2/2020 | Suslik | |
| D876,477 | S | 2/2020 | Gansert | |
| 10,621,829 | B2 | 4/2020 | Loader | |
| 2006/0287045 | A1 * | 12/2006 | Walker | G07F 17/32 463/16 |
| 2008/0045288 | A1 | 2/2008 | Moshal | |
| 2008/0207313 | A1 | 8/2008 | Acres | |
| 2009/0118000 | A1 | 5/2009 | Yoshizawa | |
| 2010/0035674 | A1 | 2/2010 | Slomiany et al. | |
| 2010/0105470 | A1 | 4/2010 | Englman | |
| 2011/0070940 | A1 | 3/2011 | Jaffe | |
| 2013/0065676 | A1 | 3/2013 | Owen et al. | |
| 2013/0072294 | A1 | 3/2013 | Mosley | |
| 2013/0122978 | A1 | 5/2013 | Slomiany et al. | |
| 2013/0252704 | A1 | 9/2013 | Gilbertson | |
| 2014/0194176 | A1 | 7/2014 | Robbins et al. | |
| 2014/0274308 | A1 | 9/2014 | Guinn | |
| 2015/0018070 | A1 | 1/2015 | Meyer | |
| 2015/0348361 | A1 | 12/2015 | Adiraju | |
| 2015/0355727 | A1 | 12/2015 | Hu | |
| 2016/0104344 | A1 | 4/2016 | Meyer | |
| 2016/0328918 | A1 | 11/2016 | De Waal et al. | |
| 2018/0052582 | A1 | 2/2018 | Hilbert et al. | |
| 2018/0146206 | A1 | 5/2018 | Weekes | |
| 2019/0066446 | A1 | 2/2019 | Mariscal | |
| 2019/0073859 | A1 | 3/2019 | Penacho | |
| 2019/0378379 | A1 | 12/2019 | Satterlie | |

OTHER PUBLICATIONS

"House of Fun," Sep. 2018 screenshot from web page: "https://www.houseoffun.com/play-now/," 1 page.

Notice of Allowance dated Jun. 17, 2020 for U.S. Appl. No. 29/682,178 (pp. 1-10).

"Gold Stacks 88 Lunar Festival Slot—Nice Session, All Features!" Feb. 14, 2019, YouTube, site visited May 27, 2020: https://www.youtube.conn/watch?v=kusOLt2fvM4 (Year: 2019).

"Figures and Polygons" Sep. 15, 2008, Themathleague, site visited May 27, 2020: https://www.mathleague.com/index.php/ connponent/content/article/31-nnathleaguewebsite/genera1/75-figuresandpolygons#octagon (Year: 2018).

"Catherine Wheels, Fireworks, android/ios game" Oct. 24, 2015, YouTube, site visited May 27, 2020: https://www.youtube.com/watch?v=DzCYicyl FJA (Year: 2015).

"Golden Firework Video Slot Casino Game with a "Mega Win" Free Spin Bonus" Apr. 16, 2018, YouTube, site visited May 27, 2020: https://www.youtube.conn/watch?v=YgCbY7c-nYM (Year 2018).

"Lucky Firecracker slot game [Wild Jackpots]" Jan. 30, 2015, YouTube, site visited May 27, 2020: https://www.youtube.com/watch?v=Gzfe182Qtbc (Year: 2015).

Office Action dated Jun. 23, 2020 for U.S. Appl. No. 29/682,179 (pp. 1-11).

"ISoftBet—Scrolls of Ra HD" May 8, 2015, YouTube, site visited Jun. 16, 2020: https://www.youtube.conn/watch?v=9ZciLdlqQNo Year: 2015).

"New Game  Fortune Scroll  Slot Lover" Feb. 11, 2019, YouTube, site visited Jun. 16, 2020: https://www.youtube.conn/watch?v=cdCsvzzRHvs&list=LLMFvEIKJd5VZ1hOwZ7BZDdQ&index=2873 (Year: 2019).

"Hot Shot Twin Fire Live Play with many features Bally Slot Machine" Jan. 8, 2017, YouTube, site visited Jun. 16, 2020: https://www.youtube.com/watch?v=b_03gJvQecw (Year 2017).

"Traditional Torah Icon" Feb. 6, 2018, Alamy, site visited Jun. 16, 2020: https://www.alamy.com/ stock-photo-traditional-torah-icon-174149305.htnnl (Year: 2018).

"Paper Scroll Clip Art" Dec. 11, 2017, FavPNG, site visited Jun. 16, 2020: https://favpng.com/png_view/ paper-scroll-clip-art-png/DDpwDsEh (Year: 2017).

"Torah Scroll Icon" Jun. 25, 2018, Depositphotos, site visited Jun. 16, 2020: https://depositphotos.com/201375256/stock-illustration-torah-scroll-icon-outline-style.html (Year: 2018).

Office Action dated Jul. 20, 2020 for U.S. Appl. No. 16/290,833 (pp. 1-9).

* cited by examiner

600

FIG. 7A
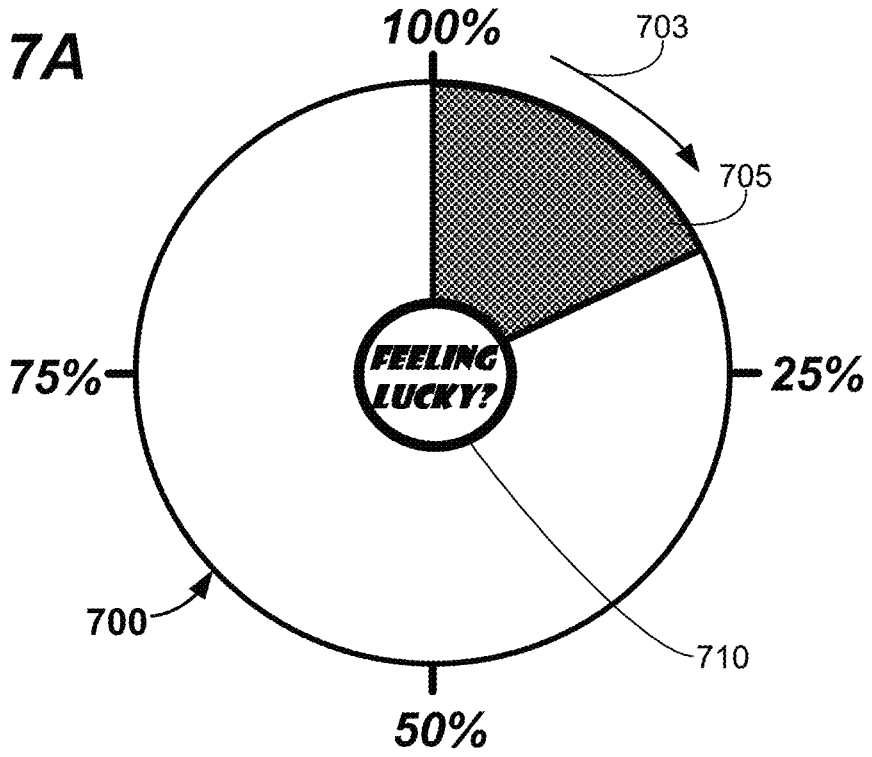
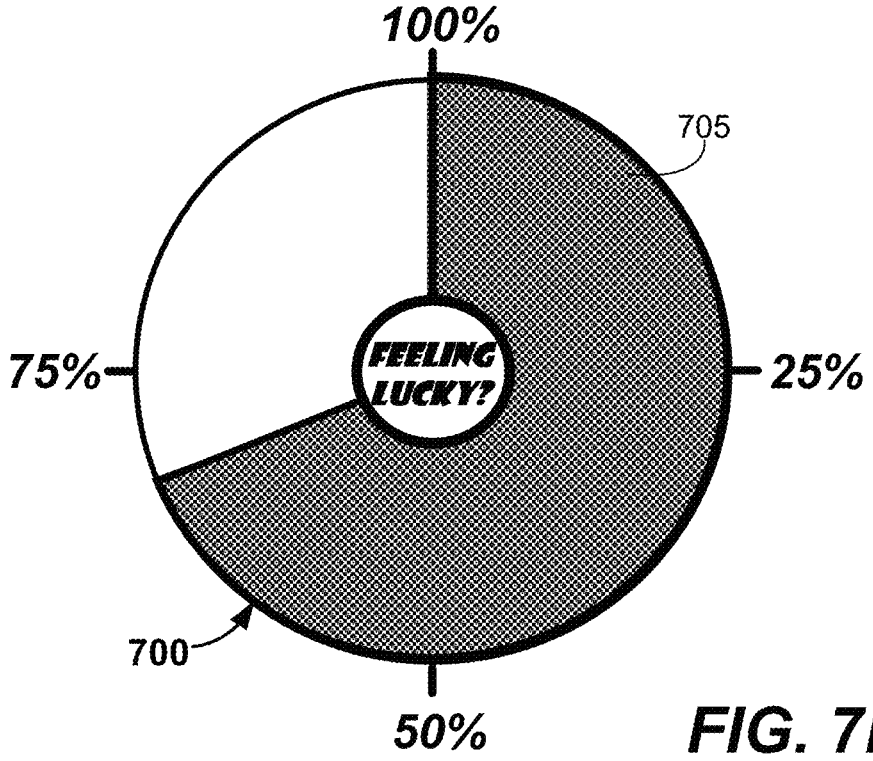
FIG. 7B

FIG. 8A
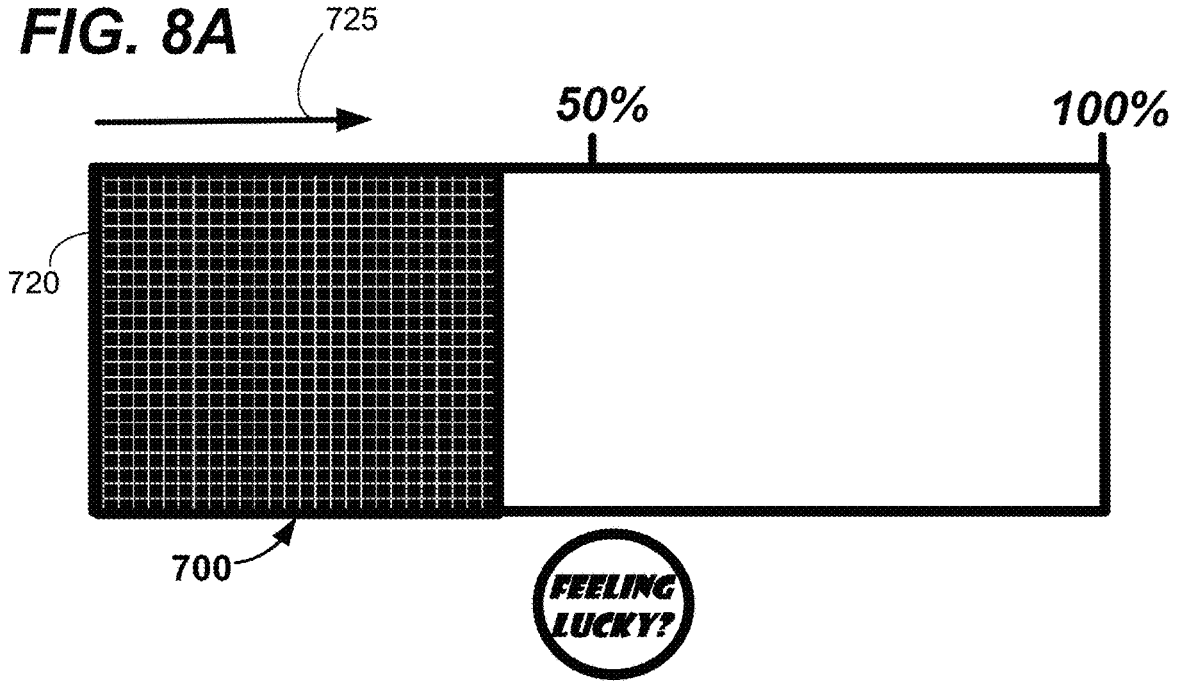
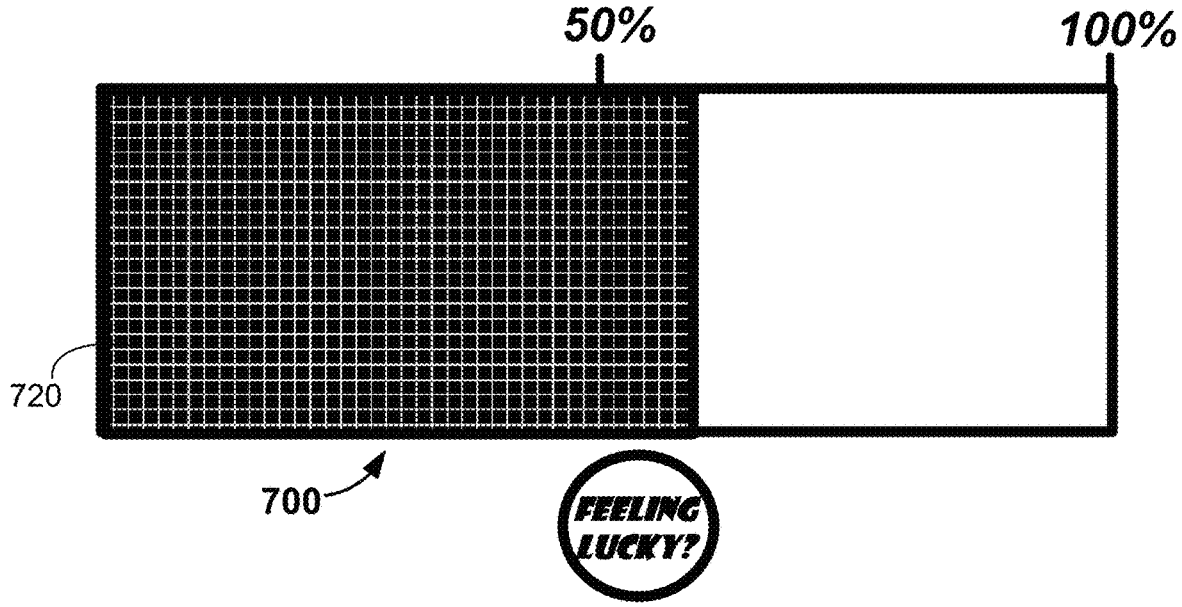
FIG. 8B

CONTROLLING AN ELECTRONIC GAMING MACHINE TO PROVIDE A BONUS FEATURE OPPORTUNITY

CROSS-REFERENCE TO RELATED APPLICATIONS

This application is related to U.S. patent application Ser. No. 16/290,838, filed on the same day of the present application and entitled "DIGITAL LOBBY AND MULTI-GAME METAMORPHICS," to U.S. patent application Ser. No. 16/290,833, filed on the same day of the present application and entitled "INDIVIDUAL METAMORPHIC LINKED JACKPOTS," to U.S. patent application Ser. No. 29/682,178, filed on the same day of the present application and entitled "DISPLAY SCREEN OR PORTION THEREOF WITH TRANSITIONAL GRAPHICAL USER INTERFACE," and to U.S. patent application Ser. No. 29/682,179, filed on the same day of the present application and entitled "DISPLAY SCREEN OR PORTION THEREOF WITH TRANSITIONAL GRAPHICAL USER INTERFACE," all of which are hereby incorporated by reference.

BACKGROUND

Electronic gaming machines ("EGMs") or gaming devices provide a variety of wagering games such as slot games, video poker games, video blackjack games, roulette games, video bingo games, keno games and other types of games that are frequently offered at casinos and other locations. Play on EGMs typically involves a player establishing a credit balance by inputting money, or another form of monetary credit, and placing a monetary wager (from the credit balance) on one or more outcomes of an instance (or single play) of a primary or base game. In many games, a player may qualify for secondary games or bonus rounds by attaining a certain winning combination or triggering event in the base game. Secondary games provide an opportunity to win additional game instances, credits, awards, jackpots, progressives, etc. Awards from any winning outcomes are typically added back to the credit balance and can be provided to the player upon completion of a gaming session or when the player wants to "cash out."

"Slot" type games are often displayed to the player in the form of various symbols arrayed in a row-by-column grid or matrix. Specific matching combinations of symbols along predetermined paths (or paylines) through the matrix indicate the outcome of the game. The display typically highlights winning combinations/outcomes for ready identification by the player. Matching combinations and their corresponding awards are usually shown in a "pay-table" which is available to the player for reference. Often, the player may vary his/her wager to include differing numbers of paylines and/or the amount bet on each line. By varying the wager, the player may sometimes alter the frequency or number of winning combinations, frequency or number of secondary games, and/or the amount awarded.

Typical games use a random number generator (RNG) to randomly determine the outcome of each game. The game is designed to return a certain percentage of the amount wagered back to the player (RTP=return to player) over the course of many plays or instances of the game. The RTP and randomness of the RNG are critical to ensuring the fairness of the games and are therefore highly regulated. Upon initiation of play, the RNG randomly determines a game outcome and symbols are then selected which correspond to that outcome. Notably, some games may include an element of skill on the part of the player and are therefore not entirely random.

SUMMARY

At least some aspects of the present disclosure may be implemented via apparatus. For example, one or more devices may be configured for performing, at least in part, the methods disclosed herein. In some implementations, the apparatus may be a gaming device, such as an EGM. The EGM may include a display system that includes one or more displays, an interface system including one or more user interfaces and a control system that includes one or more processors.

The interface system may include one or more network interfaces, one or more interfaces between the control system and a memory system, one or more interfaces between the control system and another device and/or one or more external device interfaces. The control system may include at least one of a general purpose single- or multi-chip processor, a digital signal processor (DSP), an application specific integrated circuit (ASIC), a field programmable gate array (FPGA) or other programmable logic device, discrete gate or transistor logic, or discrete hardware components. Accordingly, in some implementations the control system may include one or more processors and one or more non-transitory storage media operatively coupled to the one or more processors.

The control system may, for example, be configured for controlling the display system to present first visual effects corresponding to one or more instances of a base game. In some examples, the first visual effects may include game play items. In some implementations, the game play items may include symbols, combinations of symbols, or both symbols and combinations of symbols. The control system may be configured for determining, during the one or more instances of the base game, instances of game play items that correspond to feature credits towards an automatic award of a feature comprising one or more bonus games. In some examples, the control system may be configured for controlling the display system to present second visual effects corresponding to an accumulation of feature credits towards the automatic award of the feature.

According to some examples, the control system may be configured for receiving an indication, via the interface system, of a player's initiation of an attempt to trigger an award of the feature. The indication may, in some instances, be received at a time during which less than a number of feature credits necessary for an automatic award of the feature has been accumulated. The control system may be configured for determining whether an award of the feature will be triggered and for controlling the display system to present third visual effects corresponding to whether an award of the feature has been triggered.

In some examples, the indication of the player's initiation of an attempt to trigger an award of the feature may be received at a time during which a monetary credit balance is insufficient for playing another instance of the base game.

If the control system determines that an award of the feature will be triggered, the control system may be further configured for controlling the display system to present fourth visual effects corresponding to an award of the feature.

In some implementations, the second visual effects may include a sector of a circle. According to some such examples, the area of the sector may correspond to a percentage of feature credits necessary for an automatic award of the feature. In some such examples, the second visual effects also may include a pointer. Presenting the third visual effects may, in some such instances, include at least one of rotating the pointer or rotating the sector.

According to some such implementations, the EGM may include a sensor system residing on or under at least a portion of the display system. In some such implementations, the second visual effects may include an area within the circle. Receiving the indication of the player's initiation of an attempt to trigger an award of the feature may involve receiving an indication of a player's touch or gesture in a portion of the sensor system that corresponds with the area within the circle.

Alternatively, or additionally, in some implementations the second visual effects may include a bar. An area of the bar may correspond to a percentage of feature credits necessary for an automatic award of the feature. According to some such implementations, the second visual effects may include a pointer. Presenting the third visual effects may involve causing the pointer to slide along a line along which the bar is displayed.

According to some examples, the control system may be configured for controlling the display system to present an indication of a number of instances of the base game that have been presented since the last instance of presenting the feature.

In some implementations, the control system may be further configured for controlling the display system to display a prompt to purchase a remaining number of feature credits necessary for an automatic award of the feature.

According to some implementations, the control system may be configured for controlling the display system to display a prompt indicating that an attempt to trigger an award of the feature may be made in exchange for an additional wager. According to some such implementations, the additional wager may be a maximum wager.

At least some aspects of the present disclosure may be implemented via methods. Some such methods may involve controlling a gaming device, such as an electronic gaming machine. For example, some methods may involve controlling, via a control system of an electronic gaming machine that includes one or more processors, a display system of the electronic gaming machine to present first visual effects corresponding to one or more instances of a base game. The first visual effects may include game play items. The game play items may, for example, include symbols, combinations of symbols, or both symbols and combinations of symbols.

Some such methods may involve determining, during the one or more instances of the base game, instances of game play items that correspond to feature credits towards an automatic award of a feature comprising one or more bonus games. Some such methods may involve controlling, via the control system, the display system to present second visual effects corresponding to an accumulation of feature credits towards the automatic award of the feature.

Some such methods may involve receiving an indication, via an interface system of the electronic gaming machine that includes one or more user interfaces, of a player's initiation of an attempt to trigger an award of the feature. The indication may, in some instances, be received at a time during which less than a number of feature credits necessary for an automatic award of the feature has been accumulated.

Some such methods may involve determining whether an award of the feature will be triggered and controlling, via the control system, the display system to present third visual effects corresponding to whether an award of the feature has been triggered.

In some examples, upon determining that an award of the feature will be triggered, the method may involve controlling the display system to present fourth visual effects corresponding to an award of the feature.

In some implementations, the second visual effects may include a sector of a circle. According to some such examples, the area of the sector may correspond to a percentage of feature credits necessary for an automatic award of the feature. In some such examples, the second visual effects also may include a pointer. Presenting the third visual effects may, in some such instances, include at least one of rotating the pointer or rotating the sector.

According to some such implementations, the EGM may include a sensor system residing on or under at least a portion of the display system. In some such implementations, the second visual effects may include an area within the circle. Receiving the indication of the player's initiation of an attempt to trigger an award of the feature may involve receiving an indication of a player's touch or gesture in a portion of the sensor system that corresponds with the area within the circle.

Alternatively, or additionally, in some implementations the second visual effects may include a bar. An area of the bar may correspond to a percentage of feature credits necessary for an automatic award of the feature. According to some such implementations, the second visual effects may include a pointer. Presenting the third visual effects may involve causing the pointer to slide along a line along which the bar is displayed.

Some or all of the methods described herein may be performed by one or more devices according to instructions (e.g., software) stored on one or more non-transitory media. Such non-transitory media may include memory devices such as those described herein, including but not limited to random access memory (RAM) devices, read-only memory (ROM) devices, etc. Accordingly, various innovative aspects of the subject matter described in this disclosure can be implemented in one or more non-transitory media having software stored thereon. The software may, for example, include instructions for controlling at least one device to process audio data. The software may, for example, be executable by one or more components of a control system such as those disclosed herein. The software may, for example, include instructions for performing one or more of the methods disclosed herein.

Some such methods may involve controlling a gaming device, such as an electronic gaming machine. For example, some such methods may involve controlling, via a control system of an electronic gaming machine that includes one or more processors, a display system of the electronic gaming machine to present first visual effects corresponding to one or more instances of a base game. The first visual effects may include game play items. The game play items may, for example, include symbols, combinations of symbols, or both symbols and combinations of symbols.

Some such methods may involve determining, during the one or more instances of the base game, instances of game play items that correspond to feature credits towards an automatic award of a feature comprising one or more bonus games. Some such methods may involve controlling, via the control system, the display system to present second visual effects corresponding to an accumulation of feature credits towards the automatic award of the feature.

Some such methods may involve receiving an indication, via an interface system of the electronic gaming machine that includes one or more user interfaces, of a player's initiation of an attempt to trigger an award of the feature. The indication may, in some instances, be received at a time during which less than a number of feature credits necessary for an automatic award of the feature has been accumulated.

Some such methods may involve determining whether an award of the feature will be triggered and controlling, via the control system, the display system to present third visual effects corresponding to whether an award of the feature has been triggered.

In some examples, upon determining that an award of the feature will be triggered, the method may involve controlling the display system to present fourth visual effects corresponding to an award of the feature.

In some implementations, the second visual effects may include a sector of a circle. According to some such examples, the area of the sector may correspond to a percentage of feature credits necessary for an automatic award of the feature. In some such examples, the second visual effects also may include a pointer. Presenting the third visual effects may, in some such instances, include at least one of rotating the pointer or rotating the sector.

According to some such implementations, the EGM may include a sensor system residing on or under at least a portion of the display system. In some such implementations, the second visual effects may include an area within the circle. Receiving the indication of the player's initiation of an attempt to trigger an award of the feature may involve receiving an indication of a player's touch or gesture in a portion of the sensor system that corresponds with the area within the circle.

Alternatively, or additionally, in some implementations the second visual effects may include a bar. An area of the bar may correspond to a percentage of feature credits necessary for an automatic award of the feature. According to some such implementations, the second visual effects may include a pointer. Presenting the third visual effects may involve causing the pointer to slide along a line along which the bar is displayed.

Details of one or more implementations of the subject matter described in this specification are set forth in the accompanying drawings and the description below. Other features, aspects, and advantages will become apparent from the description, the drawings, and the claims. Note that the relative dimensions of the following figures may not be drawn to scale. Like reference numbers and designations in the various drawings generally indicate like elements.

DETAILED DESCRIPTION

Figure 1:
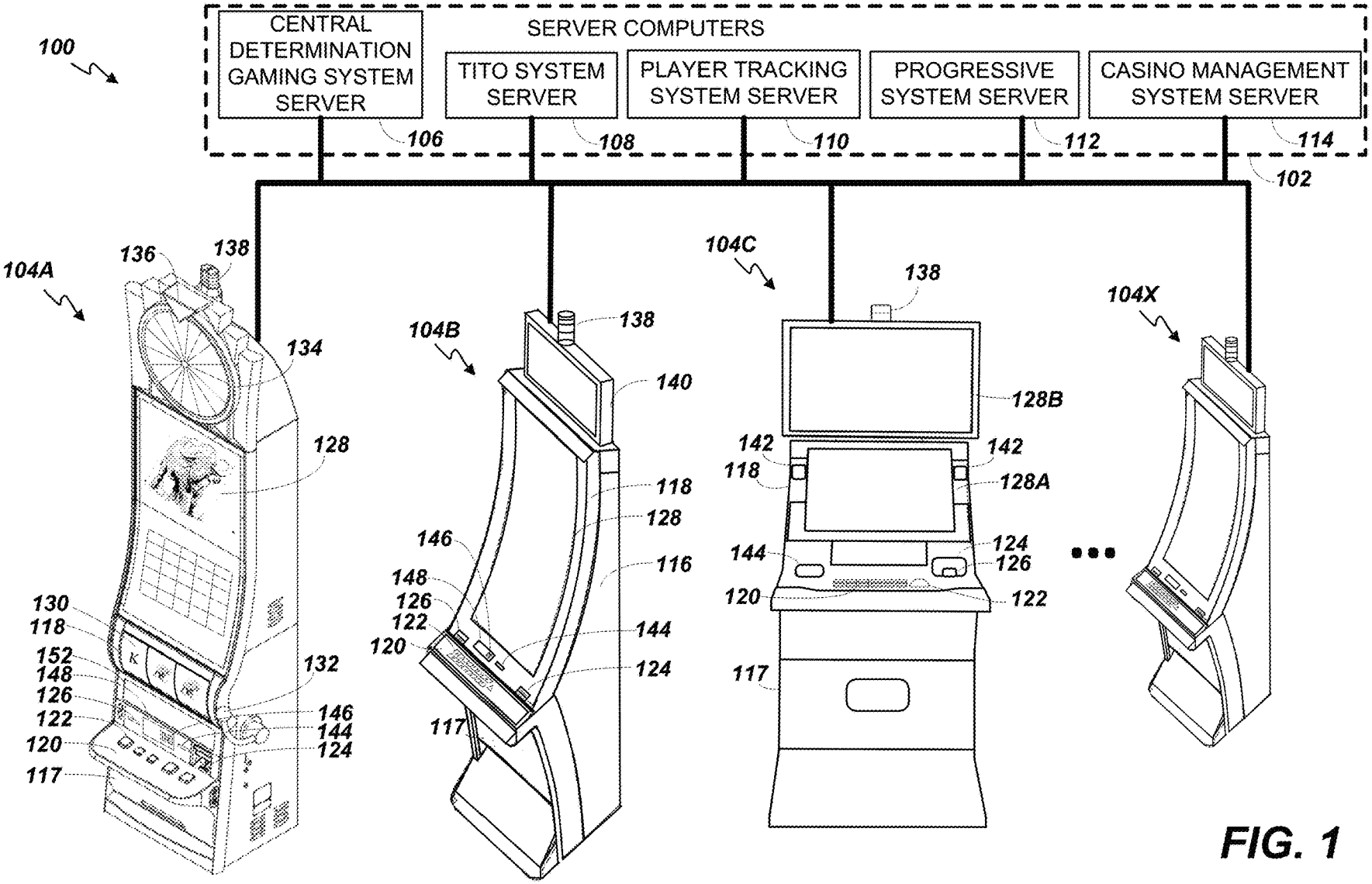
FIG. 1 is a diagram showing examples of several EGMs networked with various gaming related servers.

FIG. 1 illustrates several different models of EGMs which may be networked to various gaming related servers. The present invention can be configured to work as a system 100 in a gaming environment including one or more server computers 102 (e.g., slot servers of a casino) that are in communication, via a communications network, with one or more gaming devices 104A-104X (EGMs, slots, video poker, bingo machines, etc.). The gaming devices 104A-104X may alternatively be portable and/or remote gaming devices. Some examples are described below.

Communication between the gaming devices 104A-104X and the server computers 102, and among the gaming devices 104A-104X, may be direct or indirect, such as over the Internet through a website maintained by a computer on a remote server or over an online data network including commercial online service providers, Internet service providers, private networks, and the like. In other embodiments, the gaming devices 104A-104X may communicate with one another and/or the server computers 102 over RF, cable TV, satellite links and the like.

In some embodiments, server computers 102 may not be necessary and/or preferred. For example, the present invention may, in one or more embodiments, be practiced on a stand-alone gaming device such as gaming device 104A, gaming device 104B or any of the other gaming devices 104C-104X. However, it is typical to find multiple EGMs connected to networks implemented with one or more of the different server computers 102 described herein.

Moreover, in some implementations at least some of the EGMs may be "thin-client" or "thick-client" EGMs that are not configured for stand-alone determination of game outcomes, etc. Such client EGMs may be configured for communication with one or more of the different server computers 102 described herein, including but not limited to the central determination gaming system server 106. Some such client EGMs may, for example, be configured to accept tickets and/or cash (e.g., via a bill validator that also functions as a ticket reader) to load credits onto the client EGM, a "ticket-out" printer for outputting a credit ticket when a cash out button is pressed, a player tracking card reader, etc. Some client EGMs may include a transceiver for wireless communication with a player's mobile device, (e.g., for communication with a player's smartphone, tablet and/or mobile gaming device) a keypad 146, and/or an illuminated display 148 for reading, receiving, entering, and/or displaying player tracking information. A client EGM may include a display system, an audio system, etc., for presenting attract sequences, game presentations, etc. The game presentations may include game outcomes determined by another device, such as the central determination gaming system server 106.

The server computers 102 may include a central determination gaming system server 106, a Class II bingo server (not shown), a ticket-in-ticket-out (TITO) system server 108, a player tracking system server 110, a progressive system server 112, and/or a casino management system server 114. Gaming devices 104A-104X may include features to enable operation of any or all servers for use by the player and/or operator (e.g., the casino, resort, gaming establishment, tavern, pub, etc.). For example, game outcomes may be generated on a central determination gaming system server 106 and then transmitted over the network to any of a group of remote terminals or remote gaming devices 104A-104X that utilize the game outcomes and display the results to the players.

Gaming device 104A is often of a cabinet construction which may be aligned in rows or banks of similar devices for placement and operation on a casino floor. The gaming device 104A often includes a main door 117 which provides access to the interior of the cabinet. Gaming device 104A typically includes a button area or button deck 120 accessible by a player that is configured with input switches or buttons 122, an access channel for a bill validator 124, and/or an access channel for a ticket printer 126.

In FIG. 1, gaming device 104A is shown as a Relm XL™ model gaming device manufactured by Aristocrat® Technologies, Inc. As shown, gaming device 104A is a reel machine having a gaming display area 118 comprising a number (typically 3 or 5) of mechanical reels 130 with various symbols displayed on them. The reels 130 are independently spun and stopped to show a set of symbols within the gaming display area 118 which may be used to present or determine an outcome to the game.

In many configurations, the gaming machine 104A may have a main display 128 (e.g., video display monitor) mounted to, or above, the gaming display area 118. The main display 128 can be a high-resolution LCD, plasma, LED, or OLED panel which may be flat or curved as shown, a cathode ray tube, or other conventional electronically controlled video monitor. The main display 128 may be a touchscreen display.

In some embodiments, the bill validator 124 may also function as a "ticket-in" reader that allows the player to use a casino issued credit ticket to load credits onto the gaming device 104A (e.g., in a cashless ticket ("TITO") system). In such cashless embodiments, the gaming device 104A may also include a "ticket-out" printer 126 for outputting a credit ticket when a "cash out" button is pressed. Cashless TITO systems are well known in the art and are used to generate and track unique bar-codes or other indicators printed on tickets to allow players to avoid the use of bills and coins by loading credits using a ticket reader and cashing out credits using a ticket-out printer 126 on the gaming device 104A.

In some embodiments, a player tracking card reader 144, a transceiver for wireless communication with a player's smartphone, a keypad 146, and/or an illuminated display 148 for reading, receiving, entering, and/or displaying player tracking information is provided in EGM 104A. In such embodiments, a game controller within the gaming device 104A can communicate with the player tracking system server 110 to send and receive player tracking information.

Gaming device 104A may also include a bonus topper wheel 134. When bonus play is triggered (e.g., by a player achieving a particular outcome or set of outcomes in the primary game), bonus topper wheel 134 is operative to spin and stop with indicator arrow 136 indicating the outcome of the bonus game. Bonus topper wheel 134 is typically used to play a bonus game, but it could also be incorporated into play of the base or primary game.

A candle 138 may be mounted on the top of gaming device 104A and may be activated by a player (e.g., using a switch or one of buttons 122) to indicate to operations staff that gaming device 104A has experienced a malfunction or the player requires service. The candle 138 is also often used to indicate a jackpot has been won and to alert staff that a hand payout of an award may be needed.

There may also be one or more information panels 152 which may be a back-lit, silkscreened glass panel with lettering to indicate general game information including, for example, a game denomination (e.g., $0.25 or $1), pay lines, pay tables, and/or various game related graphics. In some embodiments, the information panel(s) 152 may be implemented as an additional video display.

Gaming devices 104A have traditionally also included a handle 132 typically mounted to the side of main cabinet 116 which may be used to initiate game play.

Figure 2:
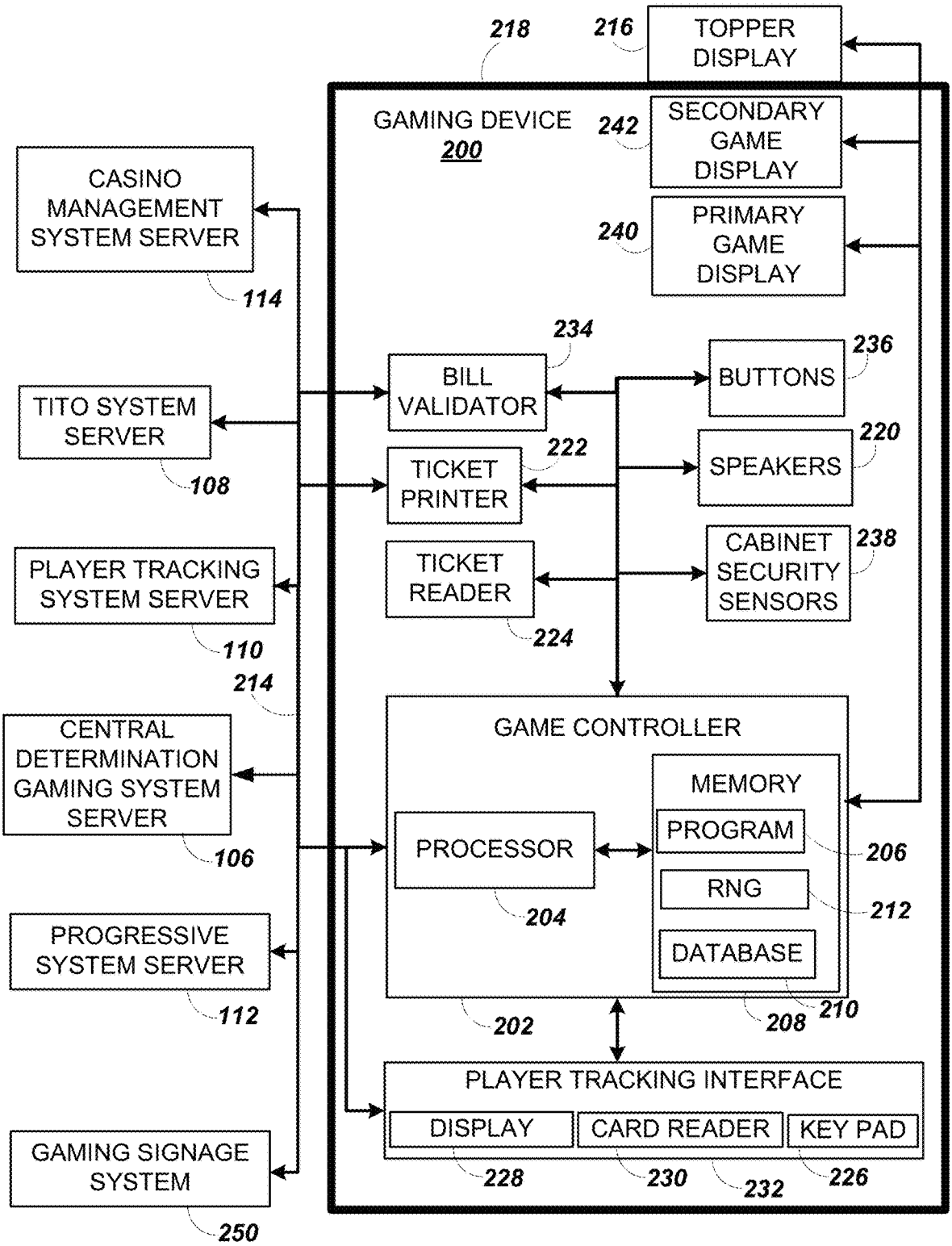
FIG. 2 is a block diagram showing examples of various functional elements of an EGM.

Many or all the above described components can be controlled by circuitry (e.g., a gaming controller) housed inside the main cabinet 116 of the gaming device 104A, the details of which are shown in FIG. 2.

Note that not all gaming devices suitable for implementing embodiments of the present invention necessarily include top wheels, top boxes, information panels, cashless ticket systems, and/or player tracking systems. Further, some suitable gaming devices have only a single game display that includes only a mechanical set of reels and/or a video display, while others are designed for bar counters or table tops and have displays that face upwards.

An alternative example gaming device 104B illustrated in FIG. 1 is the Arc™ model gaming device manufactured by Aristocrat® Technologies, Inc. Note that where possible, reference numerals identifying similar features of the gaming device 104A embodiment are also identified in the gaming device 104B embodiment using the same reference numbers. Gaming device 104B does not include physical reels and instead shows game play functions on main display 128. An optional topper screen 140 may be used as a secondary game display for bonus play, to show game features or attraction activities while a game is not in play, or any other information or media desired by the game designer or operator. In some embodiments, topper screen 140 may also or alternatively be used to display progressive jackpot prizes available to a player during play of gaming device 104B.

Example gaming device 104B includes a main cabinet 116 including a main door 117 which opens to provide access to the interior of the gaming device 104B. The main or service door 117 is typically used by service personnel to refill the ticket-out printer 126 and collect bills and tickets inserted into the bill validator 124. The door 117 may also be accessed to reset the machine, verify and/or upgrade the software, and for general maintenance operations.

Another example gaming device 104C shown is the Helix™ model gaming device manufactured by Aristocrat® Technologies, Inc. Gaming device 104C includes a main display 128A that is in a landscape orientation. Although not illustrated by the front view provided, the landscape display 128A may have a curvature radius from top to bottom, or alternatively from side to side. In some embodiments, display 128A is a flat panel display. Main display 128A is typically used for primary game play while secondary display 128B is typically used for bonus game play, to show game features or attraction activities while the game is not in play or any other information or media desired by the game designer or operator.

Many different types of games, including mechanical slot games, video slot games, video poker, video black jack, video pachinko, keno, bingo, and lottery, may be provided with or implemented within the depicted gaming devices 104A-104C and other similar gaming devices. Each gaming device may also be operable to provide many different games. Games may be differentiated according to themes, sounds, graphics, type of game (e.g., slot game vs. card game vs. game with aspects of skill), denomination, number of paylines, maximum jackpot, progressive or non-progressive, bonus games, and may be deployed for operation in Class II or Class III, etc.

FIG. 2 is a block diagram depicting examples of internal electronic components of a gaming device 200 connected to various external systems. All or parts of the example gaming device 200 shown could be used to implement any one of the example gaming devices 104A-X depicted in FIG. 1. The games available for play on the gaming device 200 are controlled by a game controller 202 that includes one or more processors 204 and a game that may be stored as game software or a program 206 in a memory 208 coupled to the processor 204. The memory 208 may include one or more mass storage devices or media that are housed within gaming device 200. Within the mass storage devices and/or memory 208, one or more databases 210 may be provided for use by the program 206. A random number generator (RNG) 212 that can be implemented in hardware and/or software is typically used to generate random numbers that are used in the operation of game play to ensure that game play outcomes are random and meet regulations for a game of chance.

Alternatively, a game instance (i.e. a play or round of the game) may be generated on a remote gaming device such as the central determination gaming system server 106. The game instance may be communicated to gaming device 200 via the network 214 and then displayed on gaming device 200. Gaming device 200 may execute game software, such as but not limited to video streaming software that allows the game to be displayed on gaming device 200. When a game is stored on gaming device 200, it may be loaded from a memory 208 (e.g., from a read only memory (ROM)) or from the central determination gaming system server 106 to memory 208. The memory 208 may include RAM, ROM or another form of storage media that stores instructions for execution by the processor 204.

The gaming device 200 may include a topper display 216 or another form of a top box (e.g., a topper wheel, a topper screen, etc.) which sits above main cabinet 218. The gaming cabinet 218 or topper display 216 may also house a number of other components which may be used to add features to a game being played on gaming device 200, including speakers 220, a ticket printer 222 which prints bar-coded tickets or other media or mechanisms for storing or indicating a player's credit value, a ticket reader 224 which reads bar-coded tickets or other media or mechanisms for storing or indicating a player's credit value, and a player tracking interface 232. The player tracking interface 232 may include a keypad 226 for entering information, a player tracking display 228 for displaying information (e.g., an illuminated or video display), and a card reader 230 for receiving data and/or communicating information to and from media or a device such as a smart phone enabling player tracking. Ticket printer 222 may be used to print tickets for a TITO system server 108. The gaming device 200 may further include a bill validator 234, buttons 236 for player input, cabinet security sensors 238 to detect unauthorized opening of the cabinet 218, a primary game display 240, and a secondary game display 242, each coupled to and operable under the control of game controller 202.

Gaming device 200 may be connected over network 214 to player tracking system server 110. Player tracking system server 110 may be, for example, an OASIS® system manufactured by Aristocrat® Technologies, Inc. Player tracking system server 110 is used to track play (e.g. amount wagered, games played, time of play and/or other quantitative or qualitative measures) for individual players so that an operator may reward players in a loyalty program. The player may use the player tracking interface 232 to access his/her account information, activate free play, and/or request various information. Player tracking or loyalty programs seek to reward players for their play and help build brand loyalty to the gaming establishment. The rewards typically correspond to the player's level of patronage (e.g., to the player's playing frequency and/or total amount of game plays at a given casino). Player tracking rewards may be complimentary and/or discounted meals, lodging, entertainment and/or additional play. Player tracking information may be combined with other information that is now readily obtainable by a casino management system.

Gaming devices, such as gaming devices 104A-104X, 200, are highly regulated to ensure fairness and, in many cases, gaming devices 104A-104X, 200 are operable to award monetary awards (e.g., typically dispensed in the form of a redeemable voucher). Therefore, to satisfy security and regulatory requirements in a gaming environment, hardware and software architectures are implemented in gaming devices 104A-104X, 200 that differ significantly from those of general-purpose computers. Adapting general purpose computers to function as gaming devices 200 is not simple or straightforward because of: 1) the regulatory requirements for gaming devices 200, 2) the harsh environment in which gaming devices 200 operate, 3) security requirements, 4) fault tolerance requirements, and 5) the requirement for additional special purpose componentry enabling functionality of an EGM. These differences require substantial engineering effort with respect to game design implementation, hardware components and software.

When a player wishes to play the gaming device 200, he/she can insert cash or a ticket voucher through a coin acceptor (not shown) or bill validator 234 to establish a credit balance on the gaming machine. The credit balance is used by the player to place wagers on instances of the game and to receive credit awards based on the outcome of winning instances. The credit balance is decreased by the amount of each wager and increased upon a win. The player can add additional credits to the balance at any time. The player may also optionally insert a loyalty club card into the card reader 230. During the game, the player views the game outcome on the game displays 240, 242. Other game and prize information may also be displayed.

For each game instance, a player may make selections, which may affect play of the game. For example, the player may vary the total amount wagered by selecting the amount bet per line and the number of lines played. In many games, the player is asked to initiate or select options during course of game play (such as spinning a wheel to begin a bonus round or select various items during a feature game). The player may make these selections using the player-input buttons 236, the primary game display 240 which may be a touch screen, or using some other device which enables a player to input information into the gaming device 200.

During certain game events, the gaming device 200 may display visual and auditory effects that can be perceived by the player. These effects add to the excitement of a game, which makes a player more likely to enjoy the playing experience. Auditory effects include various sounds that are projected by the speakers 220. Visual effects include flashing lights, strobing lights or other patterns displayed from lights on the gaming device 200 or from lights behind the information panel 152 (FIG. 1).

In this example, the gaming device 200 is also configured for communication with a gaming signage system 250 via the network 214. Various examples of gaming signage systems 250 are provided herein. According to some examples, the gaming signage system 250 may be configured for communication with other elements of a gaming system via the network 214, such as the central determination gaming system server 106, the progressive system server 112, the player tracking system server 110 the casino management system server 114 and/or the TITO system server 108.

When the player is done, he/she cashes out the credit balance (typically by pressing a cash out button to receive a ticket from the ticket printer 222). The ticket may be redeemed for money or inserted into another machine to establish a credit balance for play.

Figure 3:
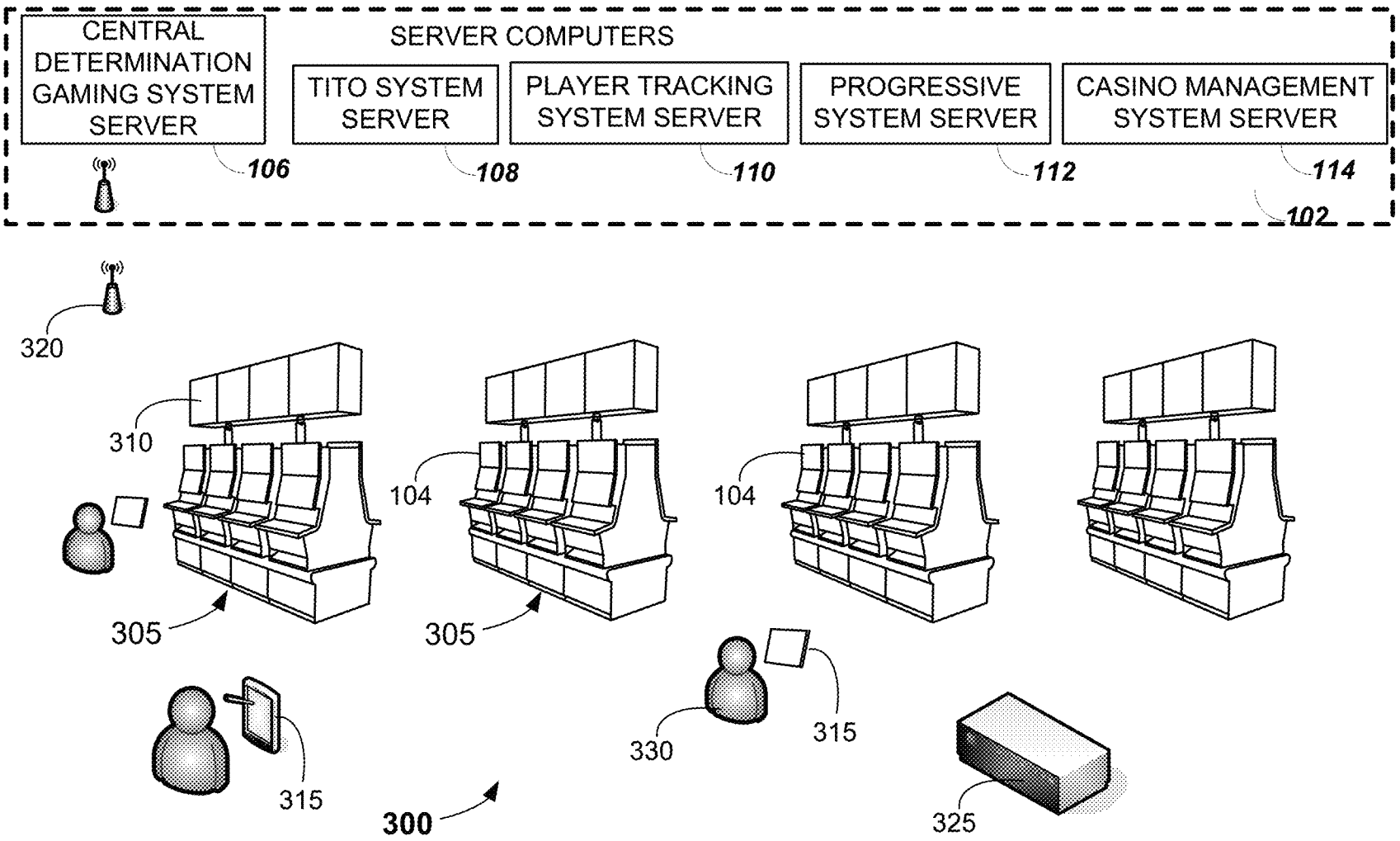
FIG. 3 depicts a casino gaming environment according to one example.

FIG. 3 depicts a casino gaming environment according to one example. In this example, the casino 300 includes banks 305 of EGMs 104. In this example, each bank 305 of EGMs 104 includes a corresponding gaming signage system 310. According to this implementation, the casino 300 also includes mobile gaming devices 315, which are also configured to present wagering games in this example. The mobile gaming devices 315 may, for example, include tablet devices, cellular phones, smart phones and/or other handheld devices. In this example, the mobile gaming devices 315 are configured for communication with one or more other devices in the casino 300, including but not limited to one or more of the server computers 102, via wireless access points 320.

According to some examples, the mobile gaming devices 315 may be configured for stand-alone determination of game outcomes. However, in some alternative implementations the mobile gaming devices 315 may be configured to receive game outcomes from another device, such as the central determination gaming system server 106, one of the EGMs 104, etc.

Some mobile gaming devices 315 may be configured to accept monetary credits from a credit or debit card, via a wireless interface (e.g., via a wireless payment app), via tickets, via a patron casino account, etc. However, some mobile gaming devices 315 may not be configured to accept monetary credits via a credit or debit card. Some mobile gaming devices 315 may include a ticket reader and/or a ticket printer whereas some mobile gaming devices 315 may not, depending on the particular implementation.

In some implementations, the casino 300 may include one or more kiosks 325 that are configured to facilitate monetary transactions involving the mobile gaming devices 315, which may include cash out and/or cash in transactions. The kiosks 325 may be configured for wired and/or wireless communication with the mobile gaming devices 315. The kiosks 325 may be configured to accept monetary credits from casino patrons 330 and/or to dispense monetary credits to casino patrons 330 via cash, a credit or debit card, via a wireless interface (e.g., via a wireless payment app), via tickets, etc. According to some examples, the kiosks 325 may be configured to accept monetary credits from a casino patron and to provide a corresponding amount of monetary credits to a mobile gaming device 315 for wagering purposes, e.g., via a wireless link such as a near-field communications link. In some such examples, when a casino patron 330 is ready to cash out, the casino patron 330 may select a cash out option provided by a mobile gaming device 315, which may include a real button or a virtual button (e.g., a button provided via a graphical user interface) in some instances. In some such examples, the mobile gaming device 315 may send a "cash out" signal to a kiosk 325 via a wireless link in response to receiving a "cash out" indication from a casino patron. The kiosk 325 may provide monetary credits to the patron 330 corresponding to the "cash out" signal, which may be in the form of cash, a credit ticket, a credit transmitted to a financial account corresponding to the casino patron, etc.

In some implementations, a cash-in process and/or a cash-out process may be facilitated by the TITO system server 108. For example, the TITO system server 108 may control, or at least authorize, ticket-in and ticket-out transactions that involve a mobile gaming device 315 and/or a kiosk 325.

Some mobile gaming devices 315 may be configured for receiving and/or transmitting player loyalty information. For example, some mobile gaming devices 315 may be configured for wireless communication with the player tracking system server 110. Some mobile gaming devices 315 may be configured for receiving and/or transmitting player loyalty information via wireless communication with a patron's player loyalty card, a patron's smartphone, etc.

According to some implementations, a mobile gaming device 315 may be configured to provide safeguards that prevent the mobile gaming device 315 from being used by an unauthorized person. For example, some mobile gaming devices 315 may include one or more biometric sensors and may be configured to receive input via the biometric sensor(s) to verify the identity of an authorized patron. Some mobile gaming devices 315 may be configured to function only within a predetermined or configurable area, such as a casino gaming area.

Figure 4:
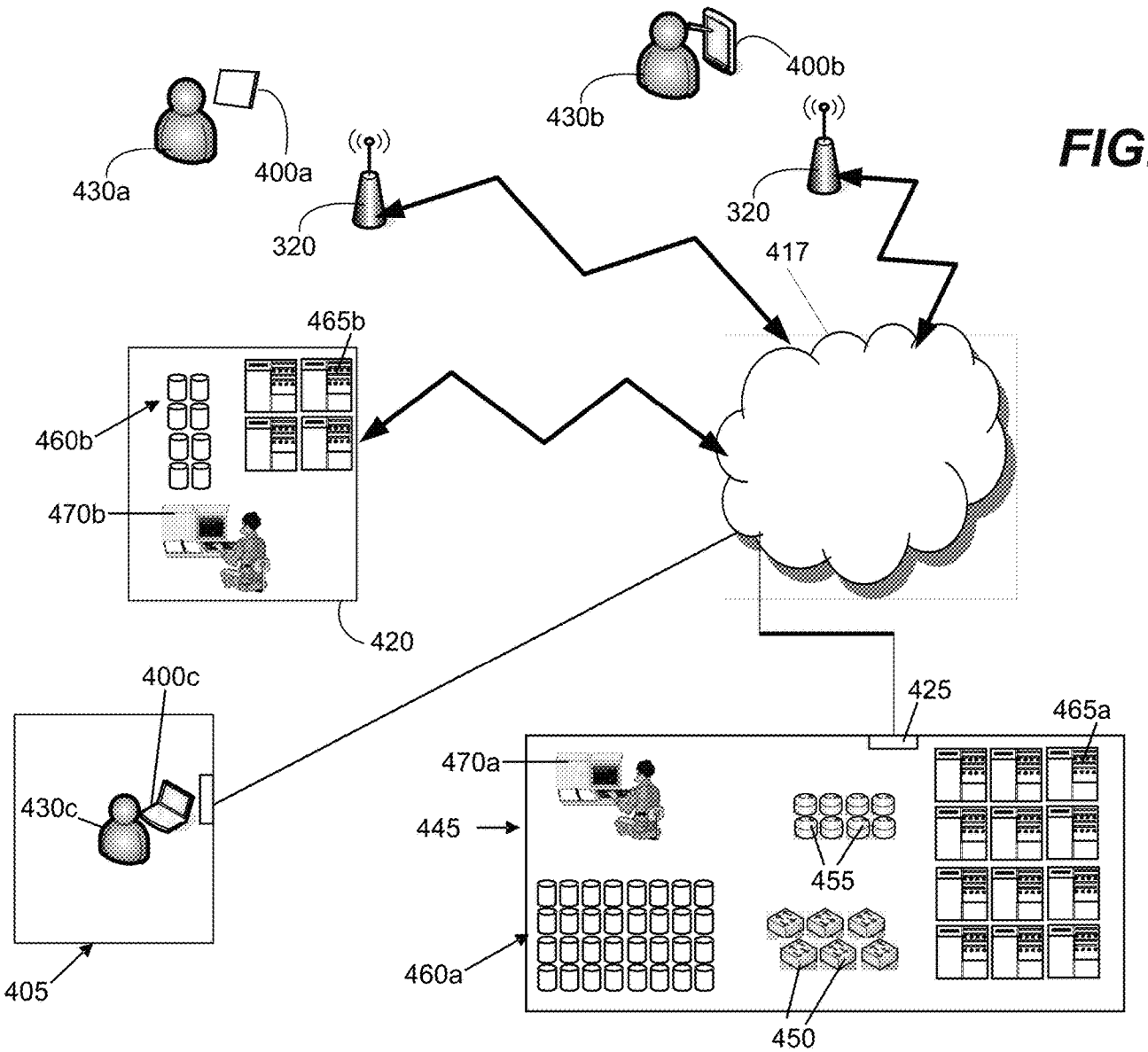
FIG. 4 is a diagram that shows examples of components of a system for providing online gaming according to some aspects of the present disclosure.

FIG. 4 is a diagram that shows examples of components of a system for providing online gaming according to some aspects of the present disclosure. As with other figures presented in this disclosure, the numbers, types and arrangements of devices shown in FIG. 4 are merely shown by way of example. In this example, various devices, including but not limited to end user devices (EUDs) 400*a*, 400*b* and 400*c* are capable of communication via one or more networks 417. The networks 417 may, for example, include one or more cellular telephone networks, the Internet, etc. In this example, the EUDs 400*a* and 400*b* are mobile devices: according to this example the EUD 400*a* is a tablet device and the EUD 400*b* is a smart phone. In this implementation, the EUD 400*c* is a laptop computer that is located within a residence 405 at the time depicted in FIG. 4. Accordingly, in this example the hardware of EUDs is not specifically configured for online gaming, although each EUD is configured with software for online gaming. Other implementations may include other types of EUD, some of which may be specifically configured for online gaming.

In this example, a gaming data center 445 includes various devices that are configured to provide online wagering games via the networks 417. The gaming data center 445 is capable of communication with the networks 417 via the gateway 425. In this example, switches 450 and routers 455 are configured to provide network connectivity for devices of the gaming data center 445, including storage devices 460*a*, servers 465*a* and one or more workstations 570*a*. The servers 465*a* may, for example, be configured to provide access to a library of games for online game play. In some examples, code for executing at least some of the games may initially be stored on one or more of the storage devices 460*a*. The code may be subsequently loaded onto a server 465*a* after selection by a player via an EUD and communication of that selection from the EUD via the networks 417. The server 465*a* onto which code for the selected game has been loaded may provide the game according to selections made by a player and indicated via the player's EUD. In other examples, code for executing at least some of the games may initially be stored on one or more of the servers 465*a*. Although only one gaming data center 445 is shown in FIG. 4, some implementations may include multiple gaming data centers 445.

In this example, a financial institution data center 420 is also configured for communication via the networks 417. Here, the financial institution data center 420 includes servers 465*b*, storage devices 460*b*, and one or more workstations 470*b*. According to this example, the financial institution data center 420 is configured to maintain financial accounts, such as checking accounts, savings accounts, loan accounts, etc. In some implementations one or more of the authorized users 430*a*-430*c* may maintain at least one financial account with the financial institution that is serviced via the financial institution data center 420.

According to some implementations, the gaming data center 445 may be configured to provide online wagering games in which money may be won or lost. According to some such implementations, one or more of the servers 465*a* may be configured to monitor player credit balances, which may be expressed in game credits, in currency units, or in any other appropriate manner. In some implementations, the server(s) 465*a* may be configured to obtain financial credits from and/or provide financial credits to one or more financial institutions, according to a player's "cash in" selections, wagering game results and a player's "cash out" instructions. According to some such implementations, the server (s) 465*a* may be configured to electronically credit or debit the account of a player that is maintained by a financial institution, e.g., an account that is maintained via the financial institution data center 420. The server(s) 465*a* may, in some examples, be configured to maintain an audit record of such transactions.

In some alternative implementations, the gaming data center 445 may be configured to provide online wagering games for which credits may not be exchanged for cash or the equivalent. In some such examples, players may purchase game credits for online game play, but may not "cash out" for monetary credit after a gaming session. Moreover, although the financial institution data center 420 and the gaming data center 445 include their own servers and storage devices in this example, in some examples the financial institution data center 420 and/or the gaming data center 445 may use offsite "cloud-based" servers and/or storage devices. In some alternative examples, the financial institution data center 420 and/or the gaming data center 445 may rely entirely on cloud-based servers.

One or more types of devices in the gaming data center 445 (or elsewhere) may be capable of executing middleware, e.g., for data management and/or device communication. Authentication information, player tracking information, etc., including but not limited to information obtained by EUDs 400 and/or other information regarding authorized users of EUDs 400 (including but not limited to the authorized users 430*a*-430*c*), may be stored on storage devices 460 and/or servers 465. Other game-related information and/or software, such as information and/or software relating to leaderboards, players currently playing a game, game themes, game-related promotions, game competitions, etc., also may be stored on storage devices 460 and/or servers 465. In some implementations, some such game-related software may be available as "apps" and may be downloadable (e.g., from the gaming data center 445) by authorized users.

In some examples, authorized users and/or entities (such as representatives of gaming regulatory authorities) may obtain gaming-related information via the gaming data center 445. One or more other devices (such EUDs 400 or devices of the gaming data center 445) may act as intermediaries for such data feeds. Such devices may, for example, be capable of applying data filtering algorithms, executing data summary and/or analysis software, etc. In some implementations, data filtering, summary and/or analysis software may be available as "apps" and downloadable by authorized users.

What will be referred to herein as "collection-based" games are popular with some players. Some collection-based games may be wagering games. Collection-based games generally involve accumulating one or more types of game play items, such as one or more types of symbols, while playing a base game in order to trigger a "feature." The feature may include a bonus game or a bonus round. In general, a player may need to play many instances of a base game in order to accumulate enough game play items to trigger an automatic award of the feature. For example, a player may need to accumulate a predetermined number of scatter symbols (e.g., 6 scatter symbols) to trigger an automatic award of the feature. In another example, every line pay in a base slot game causes a presentation of a break-up of some ice on a display of a slot reel. When all the positions of the slot reel are freed up because the ice has broken, this triggers an automatic award of the feature. In this example, the "game play items" would include positions of the slot reel that are freed up because the ice has broken.

Players like some aspects of existing collection-based wagering games. For example, collecting game play items provides the potential for an additional benefit, above and beyond the possibility of winning any particular instance of a base game. Moreover, the process of collecting game play items provides a psychological sense of "investment" in a wager gaming session, which may cause players to want to continue game play until enough game play items have been collected. Accordingly, collection-based wagering games can provide benefits both to players and to casinos.

However, some players find other aspects of existing collection-based wagering games to be less than optimal. For example, some existing collection-based wagering games allow a subsequent player of the same EGM to obtain the benefit of a player's "investment" in collecting game play items: the subsequent player may, in some instances, be able to claim all the game play items collected by the previous player and to continue collecting game play items until the subsequent player accumulates enough to trigger an automatic award of the feature. In some instances, the previous player may not like the fact that he or she is providing an involuntary benefit to another person. For example, if the previous player almost accumulated enough game play items to trigger an automatic award of the feature but then ran out of money, the previous player may feel cheated. This may be especially true if the subsequent player takes over where the previous player left off and triggers an automatic award of the feature by putting in only a little more money and playing only a few more games. The previous player may feel that "I just paid for the next person to win!"

Particular aspects of the subject matter described in this disclosure can be implemented to realize one or more of the following potential advantages. In some implementations, a player may be able to accumulate "feature credits" by collecting game play items during play of a base game. According to some examples, even if the player has not accumulated enough feature credits to trigger an automatic award of a feature, the player will have the chance to try his or her luck at triggering the feature.

For example, suppose that a player needs to accumulate 100 feature credits to trigger an automatic award of a feature. Before the player has collected all 100 feature credits, the player may choose to try his or her luck and attempt triggering the feature. In some examples, the player's chance of triggering the feature may correspond with how close the player was to accumulating enough feature credits to trigger an automatic award of a feature. According to some such examples, if the player needs to collect 100 feature credits to trigger an automatic award of a feature but had only collected N feature credits (where N is less than 100 in this example), the player's chance of triggering the feature would be N/100.

In some examples, a player might choose to attempt triggering the feature because the player is running out of money. However, in other instances a player might decide to attempt triggering the feature because the player believes that he or she has a good enough chance to try. For example, if the player has accumulated 75% of the feature credits, 80% of the feature credits, etc., the player may believe that this is close enough to attempt triggering the feature.

Figure 5:
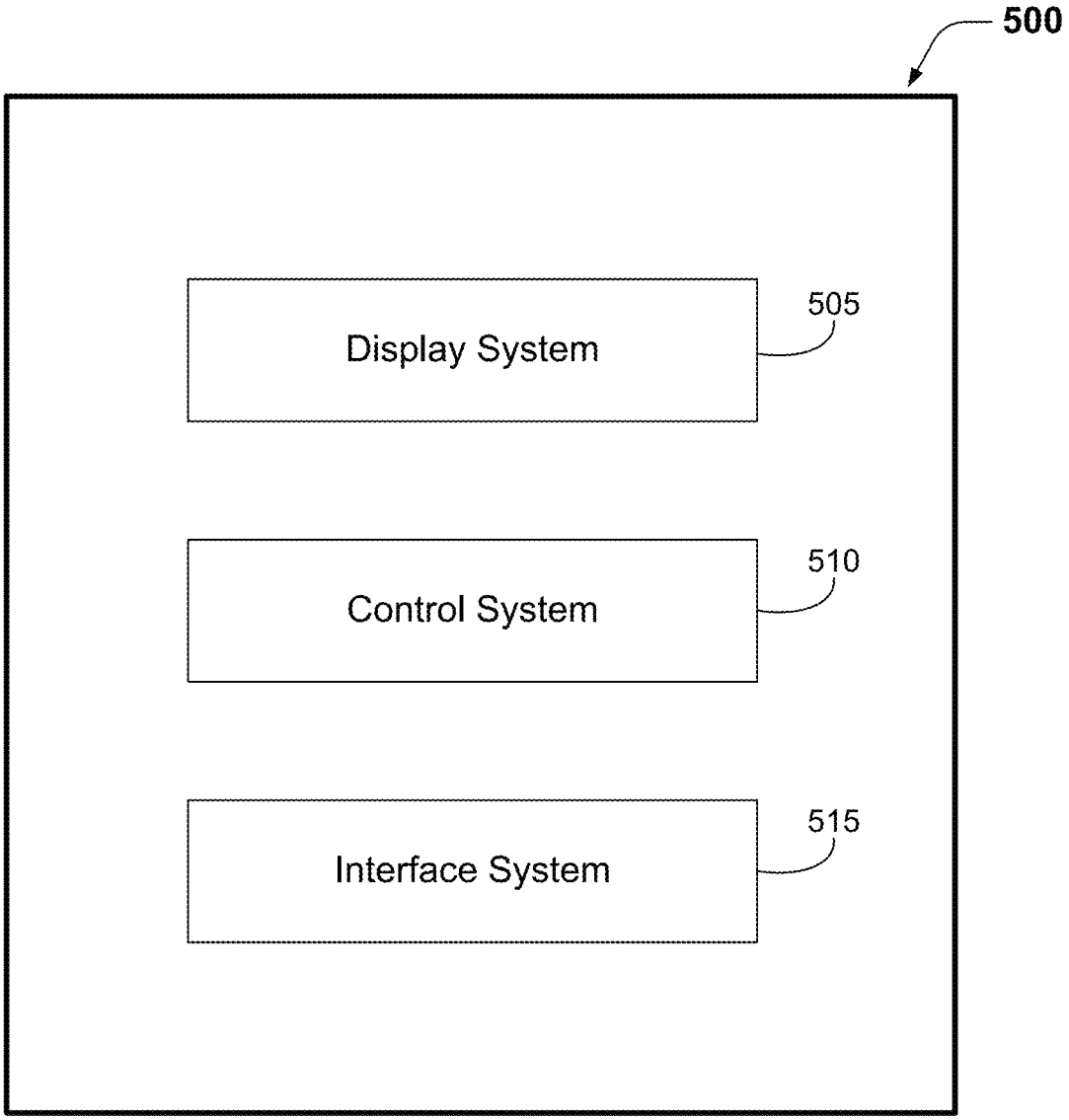
FIG. 5 is a block diagram that shows blocks of an apparatus according to one example.

FIG. 5 is a block diagram that shows blocks of an apparatus according to one example. According to some examples, the apparatus 500 may be an EGM such as those described above with reference to FIGS. 1 and 2. However, in alternative examples, the apparatus 500 may be a mobile device such as described above with reference to FIG. 3 or an EUD as described above with reference to FIG. 4. In this example, the apparatus 500 includes a display system 505 and a control system 510 that is configured to communicate with the display system 505. In this example, the control system 510 is configured to communicate with the display system 505 via wired communication, e.g., via electrical signals. In alternative implementations, the control system 510 may be configured to communicate with the display system 505 via wireless communication. Accordingly, at least a portion of the control system 510 may be coupled to the display system 505. As used herein, the term "coupled to" has a meaning that could include being physically coupled for wired communication or being configured for wireless communication.

The control system 510 may include one or more general purpose single- or multi-chip processors, digital signal processors (DSPs), application specific integrated circuits (ASICs), field programmable gate arrays (FPGAs) or other programmable logic devices, discrete gates or transistor logic, discrete hardware components, or combinations thereof. Although the interface system 515 is shown as being separate from the control system 510, in some implementations the interface system 515 may be part of the control system 510. In some implementations, the interface system 515 may include the entire control system 510. The control system 510 also may include (and/or be configured for communication with) one or more memory devices, such as one or more random access memory (RAM) devices, read-only memory (ROM) devices and/or other types of non-transitory media. In some implementations, at least a portion of the control system 510 may be implemented as a register. Accordingly, the apparatus 500 may have a memory system that includes one or more memory devices, though the memory system is not shown in FIG. 5.

The control system 510 may be capable of performing, at least in part, the methods disclosed herein. In some examples, the control system 510 may be capable of performing at least some of the methods described herein according to instructions (e.g., software) stored on non-transitory media. For example, the control system 510 may be configured for controlling the display system 505 and/or for receiving and processing data from at least a portion of the display system 505, e.g., as described below.

The display system 505 may include, one or more liquid crystal displays (LCDs), plasma displays, light-emitting diode (LED) displays, microLED displays or organic light-emitting diode (OLED) displays. According to some implementations, the display system 505 may include at least one flexible display, such as a flexible OLED. Although shown as separate components in FIG. 5, the display system 505 may, in some examples, include at least a portion of the control system 510. For example, the display system 505 may include one or more processors, microprocessors, programmable logic devices, discrete gates or transistor logic, etc.

In the example shown in FIG. 5, the apparatus 500 includes an interface system 515. In some examples, the interface system may include a wireless interface system. In some implementations, the interface system 515 may include a network interface, an interface between the control system 510 and the display system 505, an interface between the control system 510 and a memory system and/or an interface between the control system 510 and an external device interface (e.g., a port or an applications processor). In some examples, the interface system 515 may include one or more user interfaces, such as a touch screen, one or more buttons, a gesture recognition system, a voice recognition system, etc.

According to some implementations, the apparatus 500 may be a single device, whereas in other implementations the apparatus 500 may be a system that includes more than one device. Accordingly, the terms "apparatus" and "system" may sometimes be used interchangeably herein. In other examples, the apparatus 500 may be a component of another device. For example, in some implementations at least a portion of the display system 505 and/or the control system 510 may be included in more than one apparatus. For example, in some implementations at least part of the control system 510 may reside in a server, such as a central determination server, a server that tracks feature credits, etc.

Figure 6:
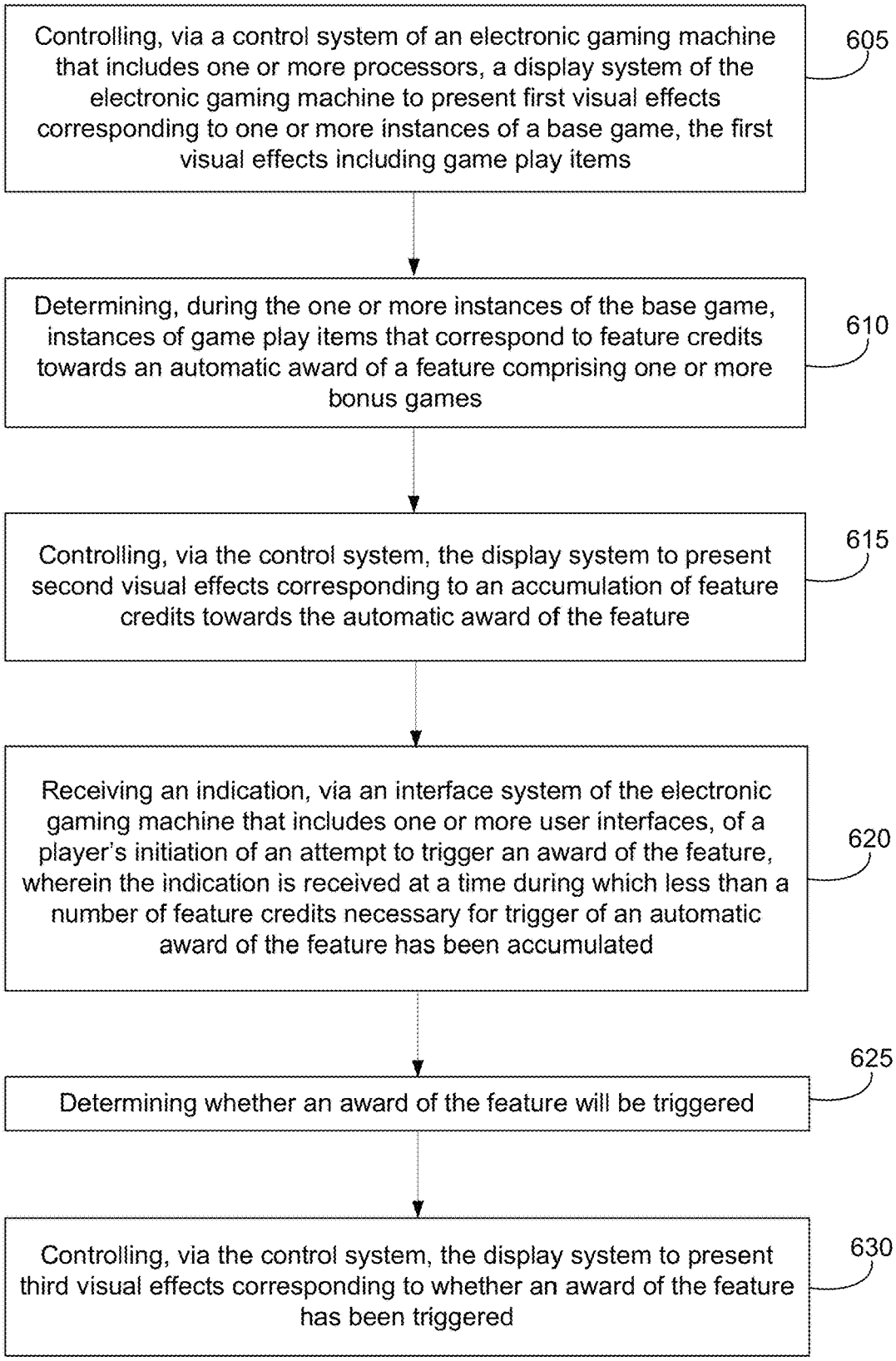
FIG. 6 is a flow diagram that shows blocks of a method according to one example.

FIG. 6 is a flow diagram that shows blocks of a method according to one example. In some examples method 600 may be performed, at least in part, by an apparatus such as that described above with reference to FIG. 5. In some examples, the method 600 may be performed by a control system (e.g., the control system 510 of FIG. 5) according to software stored upon one or more non-transitory storage media. As with other methods described herein, the number and sequence of blocks shown in FIG. 6 are merely examples. Similar disclosed methods may include more or fewer blocks. Moreover, at least some of the blocks may occur in a different sequence than the sequence that is shown in a flow diagram.

According to this example, block 605 involves controlling, via a control system of an electronic gaming machine that includes one or more processors, a display system of the electronic gaming machine to present first visual effects corresponding to one or more instances of a base game. The base game may vary according to the particular implementation. For example, the base game may be a slot game, a video poker game, etc.

In this example the first visual effects including game play items, which may include one or more individual symbols of the base game, one or more combinations of symbols of the base game, both one or more individual symbols and one or more combinations of symbols of the base game, etc. According to some examples, the game play items may include a "scatter" symbol, a "wild" symbol and/or one or more other symbols of the base game.

In this example, block 610 involves determining, during the one or more instances of the base game, instances of game play items that correspond to feature credits towards an automatic award of a feature comprising one or more bonus games. Block 610 may, in some examples, involve determining instances, or occurrences, of a particular type of symbol that corresponds with one or more feature credits. In some such examples, the occurrence of one symbol will correspond with one feature credit. However, in alternative examples the occurrence of one symbol may correspond with multiple feature credits, or less than one feature credit. In some instances, the occurrence of a first type of symbol may correspond with X feature credits and the occurrence of a second type of symbol may correspond with Y feature credits. For example, a cowboy symbol may correspond with 1, 2 or 3 feature credits and a scatter symbol may correspond with 5 or 10 feature credits.

According to some examples, the number of feature credits corresponding to a particular symbol may vary within a range. For example, in some implementations a scatter symbol may be worth between 1 and 20 feature credits. According to some such implementations wherein the number of feature credits corresponding to a particular symbol can vary within a range, the value of the feature credit may vary randomly within the range.

Alternatively, or additionally, in some examples the number of feature credits corresponding to a particular symbol may vary according to whether another symbol corresponding to feature credits lands during a single instance of a game. In some such examples, the total number of feature credits obtained may be a sum or a multiple of the individual feature credit values for each symbol. For example, if a rattlesnake symbol normally corresponds with 2 feature credits and a tombstone feature symbol normally corresponds with 3 feature credits, in some such implementations if a rattlesnake symbol and a tombstone symbol both land during a single instance of a game, each symbol may be worth 5 credits (the sum of the normal feature credit values) or 6 credits (the product of the normal feature credit values). In some alternative implementations, the feature credit value of only one of the two symbols will change if both land during a single instance of a game. For example, if the rattlesnake symbol normally corresponds with 5 feature credits and a tombstone feature symbol normally corresponds with 10 feature credits, in some such implementations if a rattlesnake symbol and a tombstone symbol both land during a single instance of a game, the feature credit value of either the rattlesnake symbol or the tombstone symbol, but not both, will change. For example, either the rattlesnake symbol or the tombstone symbol may have a feature credit value of 15 (the sum of the normal feature credit values) or of 50 (the product of the normal feature credit values).

In some examples wherein the number of feature credits corresponding to a particular symbol can vary within a range, the value of the feature credit may vary within the range according to the amount wagered for a particular game instance (e.g., a particular spin) during which the symbol landed. In one such example wherein the number of feature credits corresponding to a particular symbol can vary within a range, if the amount wagered for a particular game instance during which the symbol landed could vary within a range of 1 to 10 feature credits, if a player has placed a maximum wager the number of feature credits corresponding to the symbol may vary within a range of 5 to 10 feature credits.

According to this example, block 615 involves controlling, via the control system, the display system to present second visual effects corresponding to an accumulation of feature credits towards the automatic award of the feature. Block 615 may involve presenting one or more images that correspond with a feature credit meter, e.g., as described below with reference to FIGS. 7A-8D.

According to some implementations, the control system may be further configured for controlling the display system to present an indication of a number of instances of the base game that have been presented since the last instance of presenting the feature. Some players may perceive this information to indicate the likelihood of success if the player were to take a chance on obtaining the feature at a time during which less than a number of feature credits necessary for an automatic award of the feature has been accumulated. Accordingly, presenting an indication of a number of instances of the base game that have been presented since the last instance of presenting the feature may increase player excitement and, in some instances, may increase the likelihood that a player will continue playing the base game and/or will play the base game in the future.

In this implementation, block 620 involves receiving an indication, via an interface system of the electronic gaming machine that includes one or more user interfaces, of a player's initiation of an attempt to trigger an award of the feature. In this example, the indication is received at a time during which less than a number of feature credits necessary for trigger of an automatic award of the feature has been accumulated. For example, if a player needs to collect 20 feature credits to trigger an automatic award of a feature, in this example the indication is received at a time during which the player had accumulated fewer than 20 feature credits. In some implementations, the indication may be received via a graphical user interface (GUI) associated with a feature credit meter, e.g., as described below with reference to FIGS. 7A-8D. In some instances, the indication may be received at a time during which a player's monetary credit balance is insufficient for playing another instance of the base game.

In this example, block 625 involves determining whether an award of the feature will be triggered. According to some such examples, block 625 may involve receiving an outcome from a random number generator, which may be implemented via the EGM or via another device, such as a server. According to some implementations, the odds of triggering the feature may correspond with the ratio N/R, where N is a number of feature credits accumulated at the time the indication is received and R is the number of feature credits required for an automatic award of the feature.

However, other implementations may calculate the odds of triggering the feature in a different manner. In some such alternative implementations, there may be a nonlinear relationship between the odds of triggering the feature and the percentage of required feature credits that have been accumulated. Some such alternative examples may apply a higher weight for feature credits that are relatively closer to the number of feature credits required to trigger an automatic award of the feature. For example, if 10 feature credits are required to trigger an automatic award of the feature, some such alternative examples assign a greater weight to the ninth feature credit collected than to the first feature credit collected. For example, if 10 feature credits are required to trigger an automatic award of the feature, in some such alternative examples the odds of triggering the feature may be 6% after 1 feature credit is collected, 12% after 2 feature credits are collected, 20% after 3 feature credits are collected, 28% after 4 feature credits are collected, 38% after 5 feature credits are collected, 48% after 6 feature credits are collected, 60% after 7 feature credits are collected, 72% after 8 feature credits are collected and 86% after 9 feature credits are collected. In some such implementations, each successive feature credit that is collected may be assigned a greater weight than the previous feature credit that was collected. For example, if 10 feature credits are required to trigger an automatic award of the feature, in some such alternative examples the odds of triggering the feature may be 5% after 1 feature credit is collected, 11% after 2 feature credits are collected, 18% after 3 feature credits are collected, 26% after 4 feature credits are collected, 35% after 5 feature credits are collected, 45% after 6 feature credits are collected, 56% after 7 feature credits are collected, 68% after 8 feature credits are collected and 81% after 9 feature credits are collected. In some implementations the odds of triggering the feature may correspond to the player's remaining credit balance. For example, if the player's remaining credit balance is equal to or less than an amount of a maximum bet wager, for example equal to or less than 100% of a maximum bet wager, the player may be offered a chance to trigger the feature for a wager of that amount. According to some such examples, the odds of triggering the feature may be proportional to the wager amount. For example, if the player's remaining credit balance is 100% of a maximum bet wager, for a wager of 100% of a max bet wager by the player the odds of triggering the feature may be 50%, or, if the player's remaining credit balance is 50% of a maximum bet wager, for a wager of 50% of a maximum bet wager by the player the odds of triggering the feature may be 25%.

In the example shown in FIG. 6, block 630 involves controlling, via the control system, the display system to present third visual effects corresponding to whether an award of the feature has been triggered. In some instances, the third visual effects may include a display corresponding with congratulations to the player for triggering the feature and/or other excitement-generating visual effects leading up to a presentation of the feature. In some examples, block 630 may involve presenting audio effects on a speaker system. These visual effects, or additional visual effects, may include a presentation of the feature on the display system.

According to some alternative examples, method 600 may involve controlling the display system to display a prompt to purchase a remaining number of feature credits necessary for an automatic award of the feature. For example, if 5 more feature credits were needed for an automatic award of the feature, method 600 may involve controlling the display system (and, in some instances, an audio system) to provide a prompt indicating a specific number of game credits, a specific monetary amount, etc., that would be necessary to purchase the remaining five feature credits. In some implementations the display system may display a prompt to purchase a remaining number of feature credits necessary for an automatic award of the feature for an amount of game credits equal to the player's remaining game credit balance. Alternatively, in some implementations the display system may display a prompt to purchase a chance to trigger award of the feature for an amount of feature credits less than or equal to the existing amount of the feature credits. In one such example, if the player needs to collect 20 feature credits to trigger an automatic award of a feature and the player has collected fewer than 20 feature credits, the player may use the existing feature credits to purchase a chance to trigger an award of the feature. In some such examples the odds of triggering an award of the feature may correspond to the ratio of the amount of feature credits used to purchase the chance, to the amount of feature credits necessary to trigger an automatic award of the feature. For example, for a purchase amount of 18 feature credits the odds of triggering the feature may be 18/20 or 90%, for a purchase amount of 15 feature credits the odds of triggering the feature may be 15/20 or 75%, etc.

In some implementations a player may purchase a chance to trigger a feature, as described in the examples above, at any time during play of the game.

Additionally, in some implementations the odds of triggering a feature may be a combination of any of the examples described, e.g. a combination of a ratio of collected feature credits to credits required for automatic trigger of the feature, and a ratio of an amount of credits used to purchase a chance to trigger the feature to an amount of a max bet wager.

According to some implementations, the control system may be configured for controlling the display system (and, in some instances, an audio system) to provide a prompt indicating that an attempt to trigger an award of the feature may be made in exchange for an additional wager. The amount of the additional wager may, in some instances, correspond with a remaining number, or percentage, of feature credits necessary for an automatic award of the feature. In some such implementations, the additional wager may be a maximum wager or "Max Bet" indicated by the EGM.

FIGS. 7A-8D show examples of feature credit meters. As with other figures provided herein, the specific details of FIGS. 7A-8D are merely shown by way of example. The feature credit meters 700 of FIGS. 7A-8D are examples of the "second visual effects corresponding to an accumulation of feature credits towards the automatic award of the feature" noted in block 615 of FIG. 6. Accordingly, in these examples the feature credit meters 700 are graphical representations of accumulated feature credits. A control system of a device, such as an EGM, a mobile gaming device or an EUD, may control at least a portion of a display system to present such graphical representations of feature credit meters, or alternative graphical representations of feature credit meters.

In the examples shown in FIGS. 7A-7D, the feature credit meters 700 are configured such that the second visual effects comprise a sector 705 of a circle. In these examples, the area of the sector 705 corresponds to a percentage of feature credits necessary for an automatic award of the feature. Accordingly, in these examples the arc corresponding with the sector 705 and the angle corresponding with the sector 705 also correspond to a percentage of feature credits necessary for an automatic award of the feature. The area of the sector 705 may or may not correspond to a player's chance of being awarded the feature, if the player attempts to trigger an award of the feature at a time during which less than a number of feature credits necessary for an automatic award of the feature has been accumulated, depending on the particular implementation.

In the example shown in FIG. 7A, the feature credit meter 700 is shown at a time during which the sector 705 occupies approximately 20% of the circle, indicating that approximately 20% of the feature credits necessary for an automatic award of the feature have been accumulated at this time. According to this example, the sector 705 is shown to be enlarged in the direction of the arrow 703 as additional feature credits are accumulated. By the time depicted in FIG. 7B, the sector 705 occupies approximately 70% of the circle, indicating that approximately 70% of the feature credits necessary for an automatic award of the feature have been accumulated.

In some implementations, the color of the sector 705 may change, e.g., from colder colors to hotter colors as the size of the sector 705 increases. For example, the color of the sector 705 may be blue if only a small percentage of the feature credits necessary for an automatic award of the feature has been accumulated and may be red if nearly all of the feature credits necessary for an automatic award of the feature have been accumulated. According to some implementations, the color of the sector 705 may be blue if less than 20% of the necessary feature credits have been accumulated, green if from 20% to less than 40% of the necessary feature credits have been accumulated, yellow if from 40% to less than 60% of the necessary feature credits have been accumulated, orange if from 60% to less than 80% of the necessary feature credits have been accumulated, and red if 80% or more of the necessary feature credits have been accumulated. The reader will appreciate that these specific colors and percentage ranges are merely made by way of example; alternative examples may progress through more or fewer color ranges and may change colors at different intervals, or may change colors gradually as each additional feature credit is shown. Alternatively, or additionally, the overall size of the feature credit meter may change (e.g., may increase) as additional feature credits are accumulated. Changing the color and/or the size of the feature credit meter may add to player excitement.

FIG. 7A also shows an example of a virtual button 710, with which a player can interact to provide an indication, via an interface system of an apparatus, of a player's initiation of an attempt to trigger an award of the feature. Accordingly, a player may interact with the virtual button 710 in order to provide one example of an indication that is described above with reference to block 620 of FIG. 6. The area of the virtual button 710 may, for example, correspond with an area of a display in which at least a portion of a sensor system is disposed. The sensor system, which may be regarded as part of an interface system (such as the interface system 515 that is described above with reference to FIG. 5) may be configured for touch and/or gesture detection. Accordingly, in this example the "second visual effects" include an area within a circle, which corresponds with an area of the virtual button 710 in this instance. According to this example, the indication of the player's initiation of an attempt to trigger an award of the feature includes receiving an indication of a player's touch or gesture in a portion of the sensor system that corresponds with the area within the circle.

Although in FIGS. 7A-7D the virtual button 710 is shown within the feature credit meters 700, in alternative implementations the virtual button 710 may be shown outside an area occupied by the feature credit meter 700, or outside an area occupied by another type of feature credit meter 700.

Figure 7C:
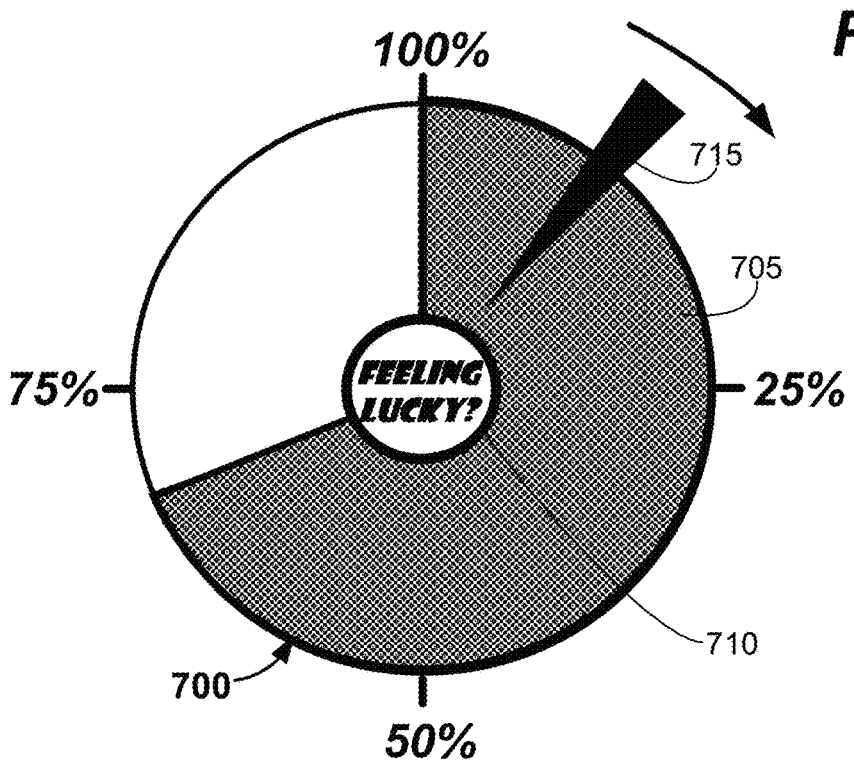
FIGS. 7A-8D show examples of feature credit meters.
Figure 7D:
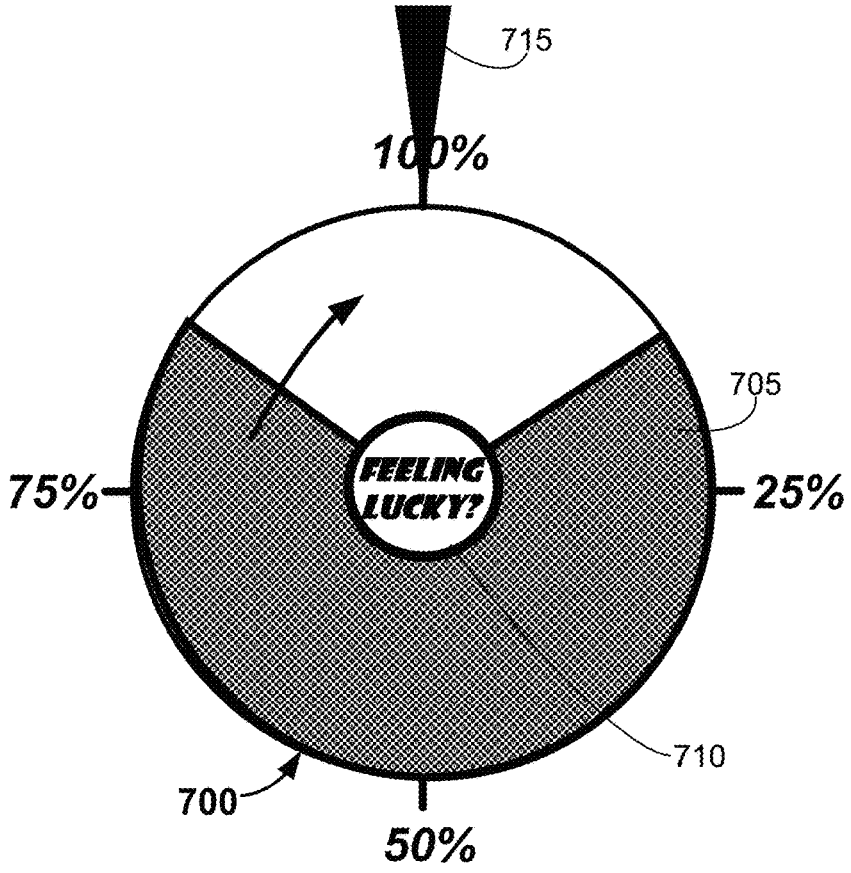

FIGS. 7C and 7D provide examples of visual effects that may be presented after receiving an indication of a player's initiation of an attempt to trigger an award of a feature. In some examples, these visual effects (or similar visual effects) may be presented after determining whether an award of the feature will be triggered. Accordingly, these graphical representations are examples of "controlling the display system to present third visual effects corresponding to whether an award of the feature has been triggered," as stated in block 630 of FIG. 6.

In the example shown in FIG. 7C, presenting the "third visual effects" involves controlling a display to cause a representation of the pointer 715 to rotate around the representation of the feature credit meter 700. If it is determined (e.g., in block 625 of method 600, shown in FIG. 6) that an award of the feature will be triggered, in this example the pointer 715 will stop somewhere within the sector 705. In this example, if it is determined that an award of the feature will not be triggered, the pointer 715 will stop somewhere outside of the sector 705.

According to the example shown in FIG. 7D, presenting the "third visual effects" involves controlling a display to cause a representation of the sector 705 to rotate around the representation of the feature credit meter 700. If it is determined that an award of the feature will be triggered, in this example the sector 705 will stop in a position such that pointer 715 is at a position within the sector 705. In this example, if it is determined that an award of the feature will not be triggered, the sector 705 will stop in a position such that pointer 715 is somewhere outside of the sector 705.

FIGS. 8A-8D show alternative examples of feature credit meters. In these examples, the second visual effects include a bar 720. According to these examples, the size of the bar 720, (e.g., an area of the bar 720) corresponds to a percentage of feature credits necessary for an automatic award of the feature.

In the example shown in FIG. 8A, the feature credit meter 700 is shown at a time during which area of the bar 720 occupies approximately 40% of the area of the feature credit meter 700, indicating that approximately 40% of the feature credits necessary for an automatic award of the feature have been accumulated at this time. According to this example, the bar 720 is shown to be enlarged in the direction of the arrow 725 as additional feature credits are accumulated. By the time depicted in FIG. 8B, the bar 720 occupies approximately 60% of the area of the feature credit meter 700, indicating that approximately 60% of the feature credits necessary for an automatic award of the feature have been accumulated.

Figure 8C:
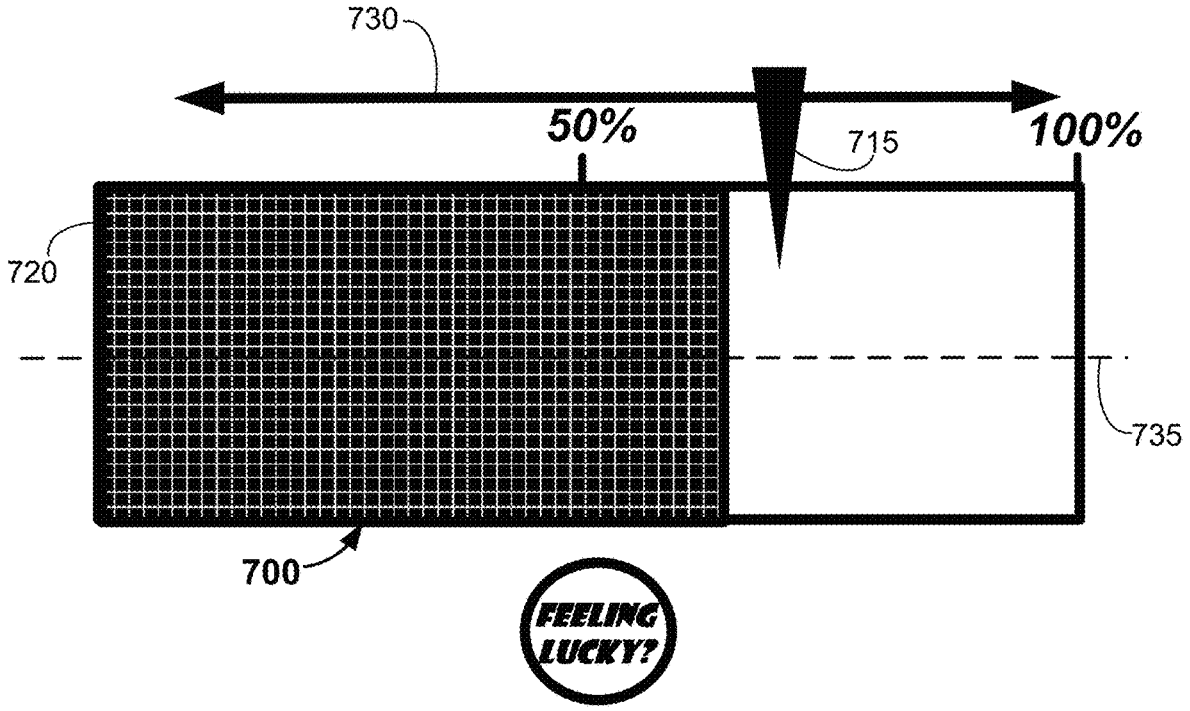

In the example shown in FIG. 8C, presenting the "third visual effects" involves causing a representation of the pointer 715 to slide back and forth along a line represented by the arrow 730, which in this example is parallel to the long axis 735 of the feature credit meter 700. If it is determined that an award of the feature will be triggered, in this example the pointer 715 will stop somewhere within the bar 720. In this example, if it is determined that an award of the feature will not be triggered, the pointer 715 will stop somewhere outside of the bar 720.

Figure 8D:
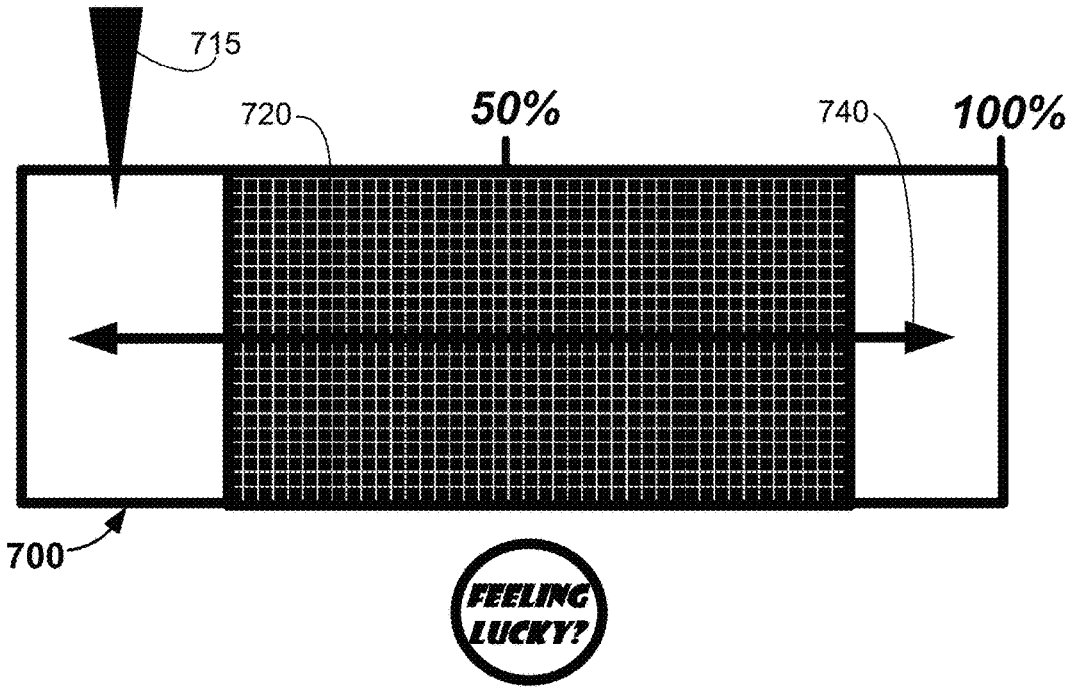

According to the example shown in FIG. 8D, presenting the "third visual effects" involves causing a representation of the bar 720 to slide back and forth along a line represented by the arrow 740, which in this example is parallel to the long axis of the feature credit meter 700. If it is determined that an award of the feature will be triggered, in this example the bar 720 will stop in a position such that the pointer 715 is at a position within the bar 720. In this example, if it is determined that an award of the feature will not be triggered, the bar 720 will stop in a position such that pointer 715 is somewhere outside of the bar 720.

Because the feature credit meter 700 may change or metamorphose over time in response to events that occur during individual instances of a game, the feature credit meter 700 may be considered to be an example of what is sometimes referred to as a "metamorphic," a "game metamorphic," a "metamorphic image," a "metamorphic meter," etc. Some such metamorphic meters are disclosed in U.S.

patent application Ser. No. 16/290,833, filed on the same day of the present application and entitled "Individual Metamorphic Linked Jackpots" which is hereby incorporated by reference.

As described in the "Individual Metamorphic Linked Jackpots" application, the feature credit meter 700 may metamorphose over time in response to events that occur during individual instances of games that are being played by more than one player. In some such examples, the feature credit meter 700 may metamorphose in response to events that occur during individual instances of games that are being played on multiple EGMs within the same casino, e.g., instances of games that are being played on multiple EGMs within the same bank of casinos. However, in alternative implementations the feature credit meter 700 may metamorphose in response to events that occur during individual instances of games that are being played on multiple networked gaming devices that may or may not be EGMs, depending on the particular implementation. In some examples, the gaming devices may include mobile devices such as those described above with reference to FIG. 3 and/or EUDs as described above with reference to FIG. 4.

The events may correspond to instances of game play items that correspond to feature credits towards an automatic award of a feature comprising one or more bonus games. The game play items may include symbols, combinations of symbols, or both symbols and combinations of symbols, e.g., as disclosed herein and/or in the "Individual Metamorphic Linked Jackpots" application.

According to some examples, each of the networked gaming devices may be configured to display an instance of the feature credit meter 700. In some such implementations, the feature credit meter 700 presented on each of the networked gaming devices may be updated according to symbols, corresponding to feature credits, that land during instances of games being played by each gaming device in a group of networked and participating gaming devices. The displayed feature credit meter 700 may or may not be similar to those shown in FIGS. 7A-8D, depending on the particular implementation. Some implementations may involve displaying multiple feature credit meters on the participating gaming devices. For example, each of the feature credit meters may correspond to an individual progressive or jackpot. In some examples, the feature credit meter(s) may be similar to those disclosed in the "Individual Metamorphic Linked Jackpots" application: for example, the feature credit meter(s) may be, or may include, strings of firecrackers that grow and/or change color as the feature credit meter(s) metamorphose. According to some examples, the feature credit meter 700 presented on some of the participating gaming devices may differ from the feature credit meter 700 presented on other participating gaming devices.

In some implementations, any player using a participating gaming device whose game instance causes the accumulated number of feature credits to equal or exceed the number of feature credits necessary for an automatic award of the feature will be awarded the feature. In some examples, any player using a participating gaming device may decide to attempt to trigger a feature at a time during which less than a number of feature credits necessary for an automatic award of the feature has been accumulated. According to some implementations, any player using a participating gaming device may decide to attempt to trigger the feature using any of the methods disclosed herein, including but not limited to methods that involve purchasing the remaining number of feature credits necessary for an automatic award of the feature.

While the invention has been described with respect to the figures, it will be appreciated that many modifications and changes may be made by those skilled in the art without departing from the spirit of the invention. Any variation and derivation from the above description and figures are included in the scope of the present invention as defined by the claims.

The invention claimed is:

1. An electronic gaming machine, comprising:

a display system including one or more displays;

a sensor system residing on or under at least a portion of the display system;

an interface system including one or more user interfaces; and a control system including one or more processors, the control system being configured for:

controlling the display system to present first visual effects corresponding to one or more instances of a base game, the first visual effects including game play items;

determining, during the one or more instances of the base game, instances of game play items that correspond to feature credits towards an automatic award of a feature comprising one or more bonus games;

controlling the display system to present second visual effects corresponding to an accumulation of feature credits towards the automatic award of the feature;

receiving an indication, via the interface system, of a player's initiation of an attempt to trigger an award of the feature, wherein the indication is received at a time during which less than a number of feature credits necessary for an automatic award of the feature has been accumulated, and wherein the indication of the player's initiation of an attempt to trigger an award of the feature comprises receiving an indication of a player's touch or gesture in a portion of the sensor system;

determining whether an award of the feature will be triggered; and controlling the display system to present third visual effects corresponding to whether an award of the feature has been triggered.

2. The electronic gaming machine of claim 1, wherein the game play items include symbols, combinations of symbols, or both symbols and combinations of symbols.

3. The electronic gaming machine of claim 1, wherein, upon determining that an award of the feature will be triggered, the control system is further configured for controlling the display system to present fourth visual effects corresponding to an award of the feature.

4. The electronic gaming machine of claim 1, wherein the second visual effects comprise a sector of a circle and wherein the area of the sector corresponds to a percentage of feature credits necessary for an automatic award of the feature.

5. The electronic gaming machine of claim 4, wherein the second visual effects further comprise a pointer and wherein presenting the third visual effects comprises at least one of rotating the pointer or rotating the sector.

6. The electronic gaming machine of claim 4, wherein the second visual effects further comprise an area within the circle and wherein the portion of the sensor system corresponds with the area within the circle.

7. The electronic gaming machine of claim 1, wherein the second visual effects comprise a bar and wherein an area of the bar corresponds to a percentage of feature credits necessary for an automatic award of the feature.

8. The electronic gaming machine of claim 7, wherein the second visual effects further comprise a pointer and wherein presenting the third visual effects comprises sliding the pointer along a line along which the bar is displayed.

9. The electronic gaming machine of claim 1, wherein the indication of the player's initiation of an attempt to trigger an award of the feature is received at a time during which a monetary credit balance is insufficient for playing another instance of the base game.

10. The electronic gaming machine of claim 1, wherein the control system is further configured for controlling the display system to present an indication of a number of instances of the base game that have been presented since the last instance of presenting the feature.

11. The electronic gaming machine of claim 1, wherein the control system is further configured for controlling the display system to display a prompt to purchase a remaining number of feature credits necessary for an automatic award of the feature.

12. The electronic gaming machine of claim 1, wherein the control system is further configured for controlling the display system to display a prompt indicating that an attempt to trigger an award of the feature may be made in exchange for an additional wager.

13. The electronic gaming machine of claim 12, wherein the additional wager is a maximum wager.

14. A method of controlling an electronic gaming machine, the method comprising:

controlling, via a control system of the electronic gaming machine that includes one or more processors, a display system of the electronic gaming machine to present first visual effects corresponding to one or more instances of a base game, the first visual effects including game play items;

determining, during the one or more instances of the base game, instances of game play items that correspond to feature credits towards an automatic award of a feature comprising one or more bonus games;

controlling, via the control system, the display system to present second visual effects corresponding to an accumulation of feature credits towards the automatic award of the feature;

receiving an indication, via an interface system of the electronic gaming machine that includes one or more user interfaces, of a player's initiation of an attempt to trigger an award of the feature, wherein the indication is received at a time during which less than a number of feature credits necessary for an automatic award of the feature has been accumulated, and wherein the indication of the player's initiation of an attempt to trigger an award of the feature comprises receiving an indication of a player's touch or gesture in a portion of a sensor system residing on or under at least a portion of the display system;

determining whether an award of the feature will be triggered; and controlling, via the control system, the display system to present third visual effects corresponding to whether an award of the feature has been triggered.

15. The method of claim 14, wherein the game play items include symbols, combinations of symbols, or both symbols and combinations of symbols.

16. The method of claim 14, wherein, upon determining that an award of the feature will be triggered, the method may involve controlling the display system to present fourth visual effects corresponding to an award of the feature.

17. The method of claim 14, wherein the second visual effects comprise a sector of a circle and wherein the area of the sector corresponds to a percentage of feature credits necessary for an automatic award of the feature.

18. The method of claim 17, wherein the second visual effects further comprise a pointer and wherein presenting the third visual effects comprises at least one of rotating the pointer or rotating the sector.

19. The method of claim 17, wherein the second visual effects further comprise an area within the circle and wherein the portion of the display system corresponds with the area within the circle that is being displayed.

20. One or more non-transitory media having software stored thereon, the software including instructions for controlling one or more devices to perform a method, the method comprising:

controlling, via a control system of an electronic gaming machine that includes one or more processors, a display system of the electronic gaming machine to present first visual effects corresponding to one or more instances of a base game, the first visual effects including game play items;

determining, during the one or more instances of the base game, instances of game play items that correspond to feature credits towards an automatic award of a feature comprising one or more bonus games;

controlling, via the control system, the display system to present second visual effects corresponding to an accumulation of feature credits towards the automatic award of the feature;

receiving an indication, via an interface system of the electronic gaming machine that includes one or more user interfaces, of a player's initiation of an attempt to trigger an award of the feature, wherein the indication is received at a time during which less than a number of feature credits necessary for an automatic award of the feature has been accumulated, and wherein the indication of the player's initiation of an attempt to trigger an award of the feature comprises receiving an indication of a player's touch or gesture in a portion of a sensor system residing on or under at least a portion of the display system;

determining whether an award of the feature will be triggered; and controlling, via the control system, the display system to present third visual effects corresponding to whether an award of the feature has been triggered.

* * * * *